US010596810B2

(12) United States Patent
Suzuki

(10) Patent No.: US 10,596,810 B2
(45) Date of Patent: Mar. 24, 2020

(54) LIQUID JETTING APPARATUS

(71) Applicant: BROTHER KOGYO KABUSHIKI KAISHA, Nagoya-shi, Aichi-ken (JP)

(72) Inventor: Shuhei Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/196,160

(22) Filed: Nov. 20, 2018

(65) Prior Publication Data

US 2019/0291414 A1 Sep. 26, 2019

(30) Foreign Application Priority Data

Mar. 26, 2018 (JP) ..... 2018-058006

(51) Int. Cl.

| | |
|---|---|
| ***B41J 2/045*** | (2006.01) |
| ***B41J 2/17*** | (2006.01) |
| ***B41J 2/165*** | (2006.01) |
| ***B41J 2/175*** | (2006.01) |

(52) U.S. Cl.

CPC ..... *B41J 2/0457* (2013.01); *B41J 2/04573* (2013.01); *B41J 2/1707* (2013.01); *B41J 2/16526* (2013.01); *B41J 2/17596* (2013.01)

(58) Field of Classification Search

CPC .... B41J 2/0457; B41J 2/1707; B41J 2/04573; B41J 2/17596; B41J 2/16526; B41J 2/14209; B41J 2202/12; B41J 2002/14419; B41J 2002/14225; B41J 29/38; B41J 2/17523; B41J 2/175

See application file for complete search history.

(56) References Cited

U.S. PATENT DOCUMENTS

2009/0284563 A1 11/2009 Bansyo
2011/0115844 A1* 5/2011 Ozawa ..... B41J 2/16552 347/28

FOREIGN PATENT DOCUMENTS

| | | | |
|---|---|---|---|
| JP | 2009-143168 | A | 7/2009 |
| JP | 2009-274360 | A | 11/2009 |
| JP | 2012-096464 | A | 5/2012 |

* cited by examiner

*Primary Examiner* — Bradley W Thies
(74) *Attorney, Agent, or Firm* — Scully, Scott, Murphy & Presser, PC

(57) ABSTRACT

A liquid jetting apparatus includes: a liquid jetting head having individual channels, first and second common channels connected to the individual channels, the individual channels having nozzles respectively; a pump which circulates liquid inside the liquid jetting head; and a controller. The controller is configured to: reduce a unit circulation amount of the liquid in stages as standby time becomes longer, the unit circulation amount being a circulation amount of the liquid per unit time by the pump, the standby time being a length of time during which a standby state is continued, the standby state being a state in which the liquid jetting head is ready without jetting the liquid; and in a case of shifting the liquid jetting head from the standby state to a jetting operation, determine a type of recovery operations in accordance with the standby time.

16 Claims, 20 Drawing Sheets

LIQUID JETTING APPARATUS

CROSS REFERENCE TO RELATED APPLICATION

The present application claims priority from Japanese Patent Application No. 2018-058006, filed on Mar. 26, 2018, the disclosure of which is incorporated herein by reference in its entirety.

BACKGROUND

Field of the Invention

The present invention relates to a liquid jetting apparatus which jets liquid from nozzles.

Description of the Related Art

In an ink-jet recording apparatus described in Japanese Patent Application Laid-open No. 2012-96464, thickening of ink near nozzles when ink is not jetted is prevented by circulating the ink inside a head all the time. Moreover, the ink-jet recording apparatus includes a maintenance section which carries out maintenance such as nozzle cleaning.

SUMMARY

As in the ink-jet recording apparatus, in a case of circulating the ink inside the head, electric power consumption becomes large. On the other hand, in a case of resolving the problem of thickening of ink in the nozzle only by maintenance in the maintenance section without circulating the ink inside the head in order to suppress the electric power consumption, maintenance by the maintenance section takes time at the time of restoring the head from a standby state to a jetting operation in which the ink is jetted. Consequently, tit takes time before recording is started.

An object of the present teaching is to provide a liquid jetting apparatus in which electric power consumption is suppressed and jetting of liquid by a liquid jetting head is quickly started.

According to an aspect of the present teaching, there is provided a liquid jetting apparatus including: a liquid jetting head having individual channels, a first common channel connected to the individual channels, and a second common channel connected to the individual channels, the individual channels having nozzles respectively; a pump configured to circulate liquid inside the liquid jetting head by generating a flow of the liquid from the first common channel toward the second common channel via the individual channels; and a controller, wherein the controller is configured to: reduce a unit circulation amount of the liquid in stages as standby time becomes longer, the unit circulation amount being a circulation amount of the liquid per unit time by the pump, the standby time being a length of time during which a standby state is continued, the standby state being a state in which the liquid jetting head is ready without jetting the liquid from the nozzles; and in a case of shifting the liquid jetting head from the standby state to a jetting operation of jetting the liquid from the nozzles, determine a type of recovery operations for resolving thickening of the liquid inside the nozzles in accordance with the standby time at the time of shifting from the standby state to the jetting operation.

DESCRIPTION OF THE EMBODIMENTS

Embodiments of the present teaching will be described below.

<Overall Arrangement of Printer 1>

Figure 1:
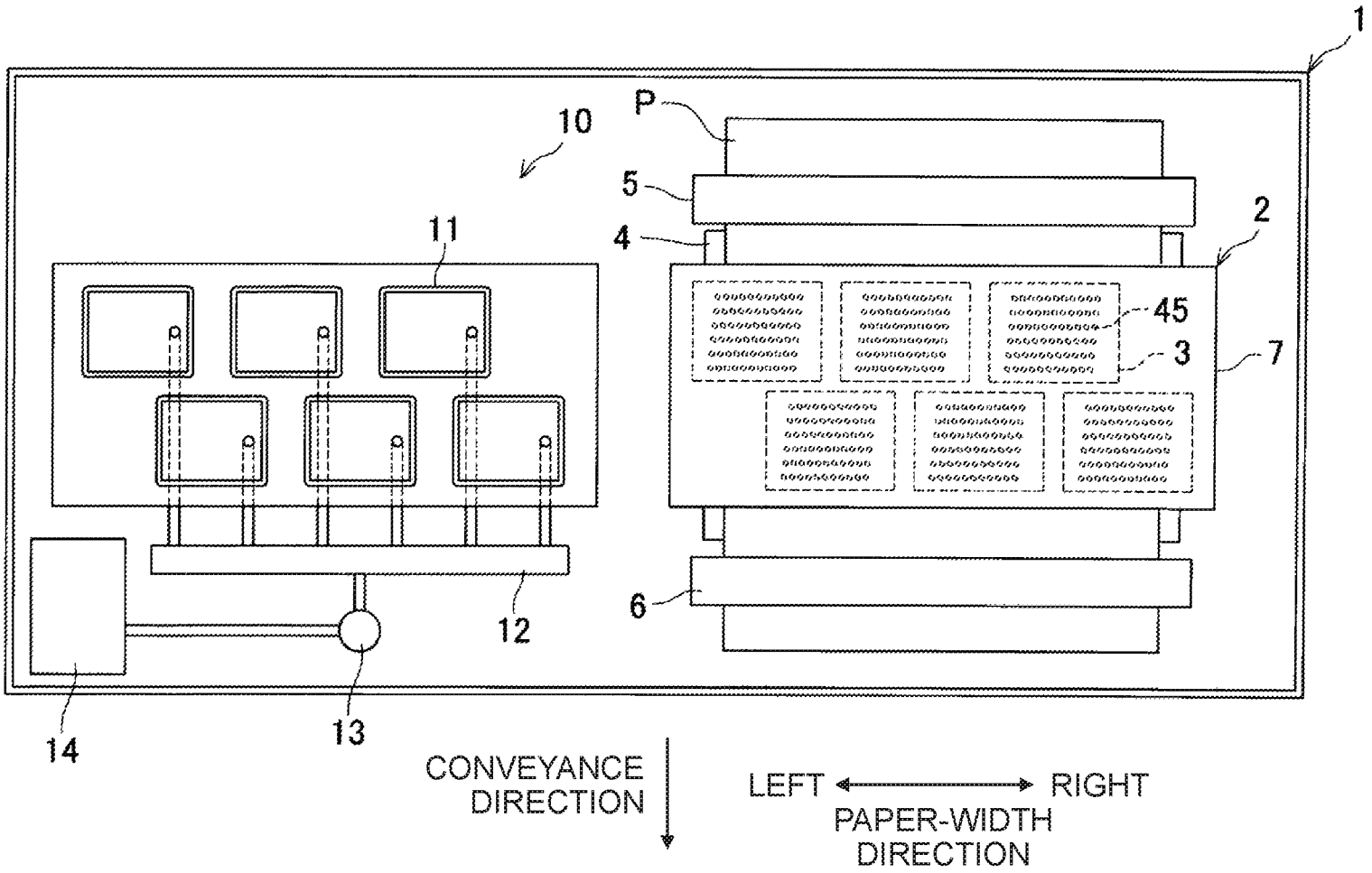
FIG. 1 is a schematic block diagram of a printer according to a first embodiment.

As depicted in FIG. 1, a printer 1 according to the present embodiment (an example of "liquid jetting apparatus" of the present teaching) includes an ink-jet head 2 (an example of "liquid jetting head" of the present teaching), a platen 4, conveyance rollers 5 and 6, and a purge unit 10 (an example of "purge mechanism" of the present teaching).

The ink-jet head 2 is a so-called line head, and includes six head units 3, and a frame 7 to which the six head units 3 are attached. Each head unit 3 is driven by a driver IC 59 (refer to FIG. 5), and jets ink from nozzles 45 formed in a lower surface thereof.

Moreover, the six head units 3 form two head unit rows. The two head unit rows are arranged in a conveyance direction orthogonal to a paper-width direction. The three head units 3 forming each head unit row are aligned in the paper-width direction. Positions of three head units 3 forming one of the head unit rows are shifted in the paper-width direction with respect to positions of the three head units 3 forming the other head unit. Accordingly, in the ink-jet head 2, in the paper-width direction, six head units 3 are arranged throughout the overall length of a recording paper P. The head unit 3 will be described later in detail. The description below is made by defining a right side and a left side of the paper-width direction as depicted in FIG. 1.

The platen 4 is arranged to face a lower surface of the ink-jet head 2. A length in the paper-width direction of the platen 4 is longer than a length in the paper-width direction of the recording paper P. The platen 4 supports the recording paper P from below. The conveyance rollers 5 and 6 are arranged at an upstream side and a downstream side respectively of the ink-jet head 2 in the conveyance direction which is orthogonal to the paper-width direction. The conveyance rollers 5 and 6 are connected to a conveyance motor 57 (refer to FIG. 5) via a gear etc. not depicted in the diagram. As the conveyance motor 57 is driven, the conveyance rollers 5 and 6 rotate, and the recording paper P is conveyed in the conveyance direction.

Moreover, in the printer 1, printing is carried out on the recording paper P by making the six head units 3 carry out a jetting operation of jetting ink from the nozzles 45 while making the conveyance rollers 5 and 6 convey the recording paper in the conveyance direction.

<Purge Unit 10>

As depicted in FIG. 1, the purge unit 10 includes six nozzle caps 11, a switching unit 12, a pump for purge (hereinafter, "purge pump") 13, and a waste-liquid tank 14. The six nozzle caps 11 are arranged on a left side of the platen 4. The six nozzle caps 11 correspond to the six head unit 3. In other words, the six nozzle caps 11 form two nozzle cap rows. The two nozzle cap rows are arranged in the conveyance direction. The three nozzle 11 caps forming each nozzle cap row are aligned in the paper width direction. Positions of the three nozzle caps 11 forming one of the nozzle cap rows are shifted in the paper-width direction with respect to positions of the three nozzle caps 11 forming the other nozzle cap row.

The printer 1 includes a head moving mechanism 56 (refer to FIG. 5) which moves the ink-jet head 2 in the paper-width direction. The head moving mechanism 56 moves the ink-jet head 2 to a print position at which the six head units 3 face the recording paper P on the platen 4 and a facing position at which the six head units 3 face the corresponding nozzle caps 11. In the present embodiment, a state in which the ink-jet head 2 is positioned at the facing position is equivalent to the "facing state", and a state in which the six head units 3 are not facing the corresponding six nozzle caps 11 is equivalent to the "non-facing state" of the present teaching. Moreover, the head moving mechanism 56 which switches to the facing state and the non-facing state by moving the ink-jet head 2 in the paper-width direction is equivalent to the "first relative movement mechanism" of the present teaching.

Figure 5:
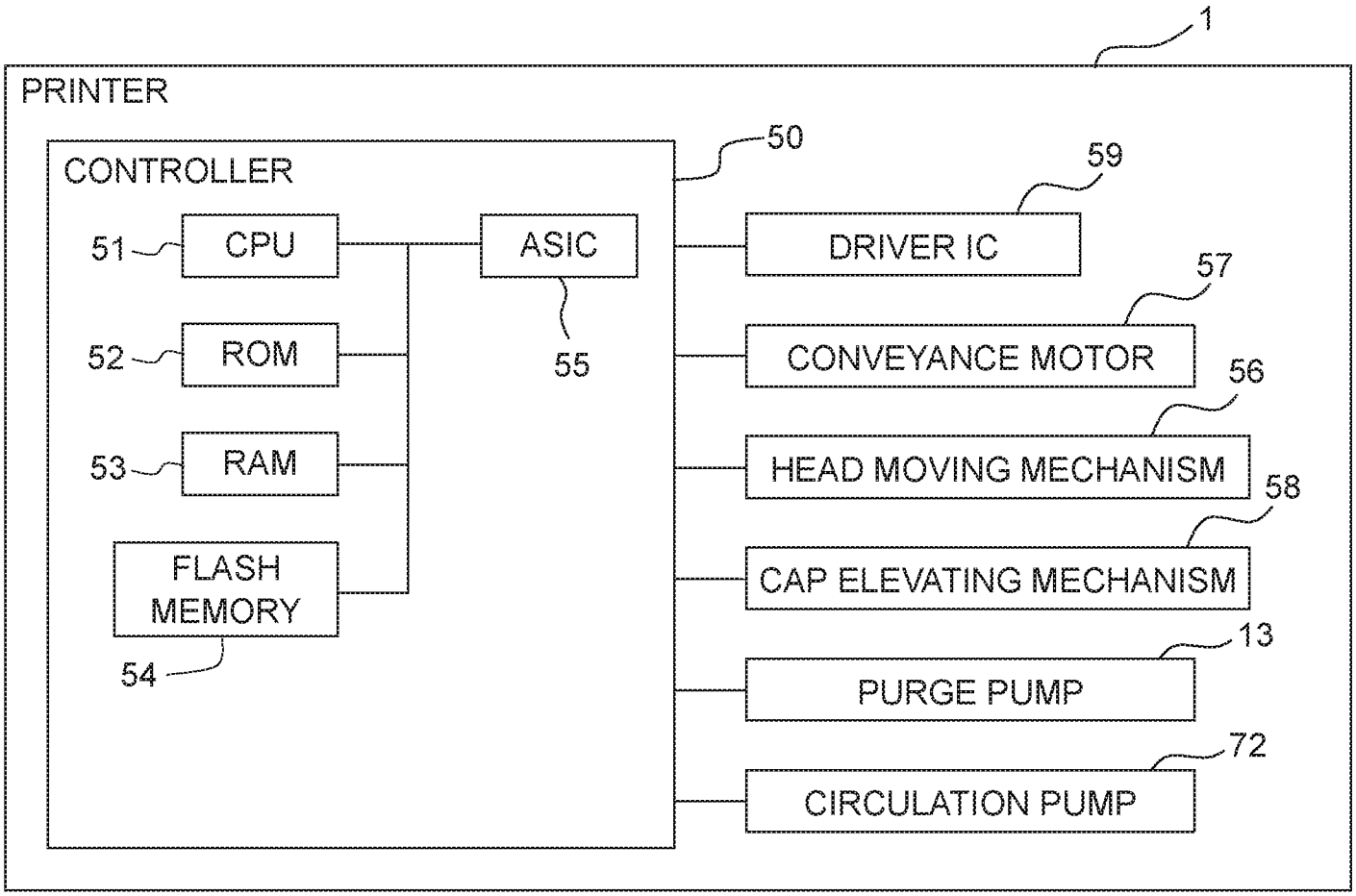
FIG. 5 is a block diagram depicting an electrical configuration of the printer.

The six nozzle caps 11 are made to ascend and descend by a cap elevating mechanism 58 (refer to FIG. 5). In the facing state, as the six nozzle caps 11 are made to ascend, the nozzles 45 of each head unit 3 are covered by the corresponding nozzle caps 11. As the six nozzle caps 11 are made to descend, the nozzle caps 11 are separated away from the corresponding head unit 3. A state in which each nozzle cap 11 covers the nozzles 45 of the corresponding head unit 3 is an example of the "capping state" of the present teaching, and a state in which each nozzle cap 11 is away from the corresponding head unit 3 is an example of the "uncapping state" of the present teaching. Moreover, the cap elevating mechanism 58 which switches between the capping state and the uncapping state by making the six nozzle caps 11 ascend and descend is an example of the "second relative movement mechanism" of the present teaching. Furthermore, in the present embodiment, each nozzle cap 11 serves both as the "cap" and the "liquid receiver" of the present teaching.

The switching unit 12 is connected to the six nozzle caps 11 and the purge pump 13. The switching unit 12 selectively connects one of the six nozzle caps 11 to the purge pump 13. The purge pump 13 is a tube pump. Moreover, the purge pump 13 is connected to the waste-liquid tank 14.

In the purge unit 10, in the capping state, the nozzle caps 11 to be connected to the purge pump 13 are switched in order by the switching unit 12. Every time the nozzle cap 11 is switched, a suction purge in which the inks inside the six head units 3 are sucked by driving the purge pump 13 is carried out. The inks discharged by the suction purge are stored in the waste-liquid tank 14.

<Head Unit 3>

Figure 2:
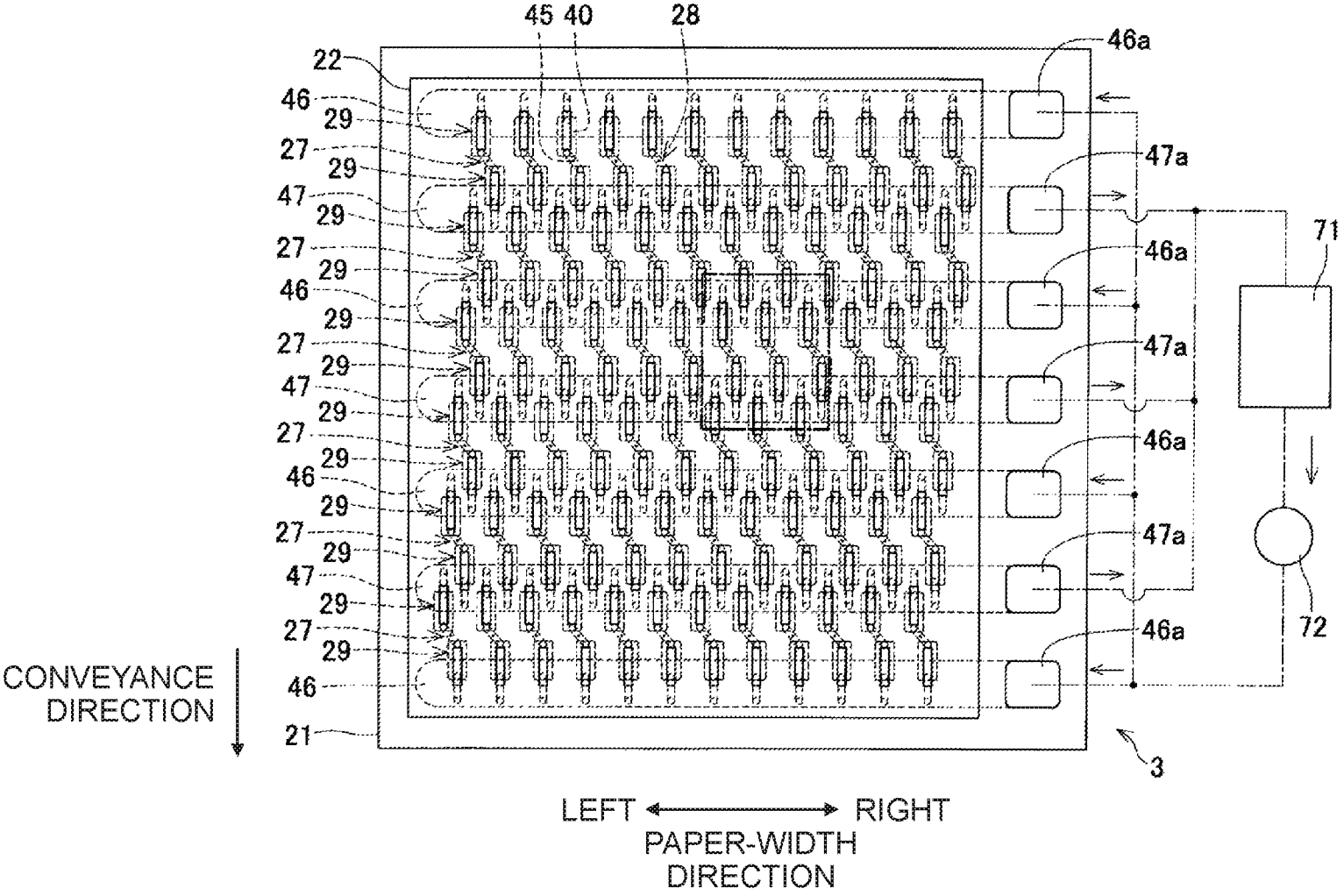
FIG. 2 is a plan view of an ink-jet head in FIG. 1.
Figure 3:
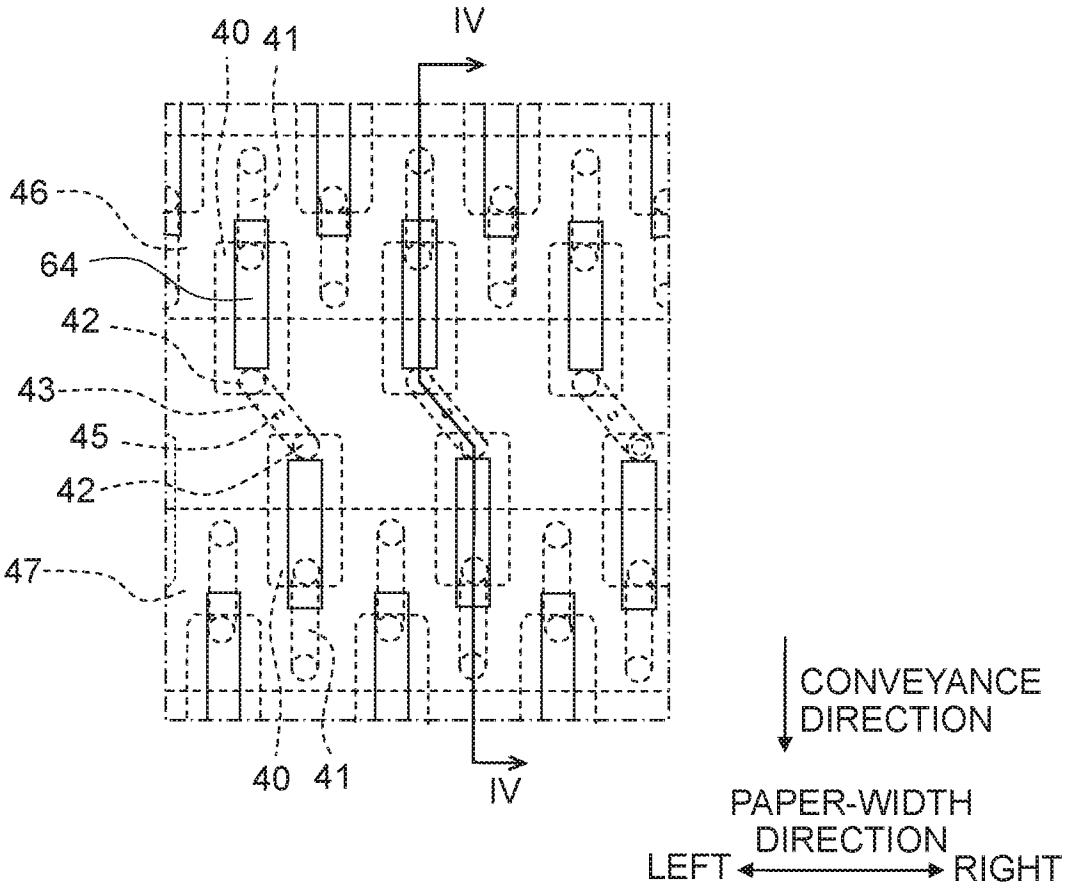
FIG. 3 is an enlarged view of a portion surrounded by alternate long and short dashed lines in FIG. 2.
Figure 4:
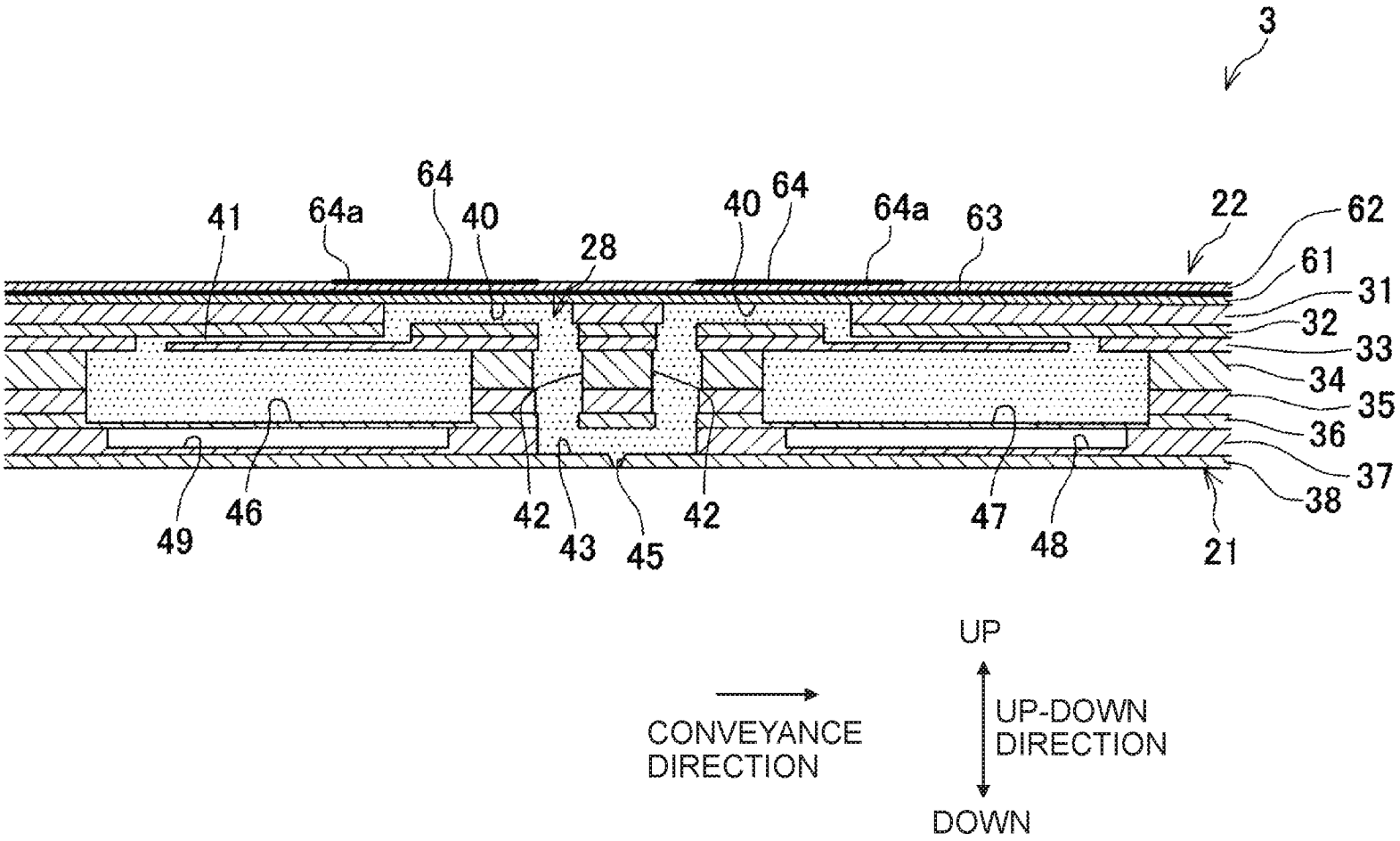
FIG. 4 is a cross-sectional view along a line IV-IV in FIG. 3.

Next, the head unit 3 will be described below in detail. As depicted in FIG. 2 to FIG. 4, the head unit 3 includes a channel unit 21 in which ink channels such as the nozzles 45 and pressure chambers 40 that will be described later are formed, and a piezoelectric actuator 22 which applies a pressure to the ink in the pressure chamber 40.

<Channel Unit 21>

The channel unit 21 is formed by eight plates 31 to 38 stacked in this order from the top. The pressure chambers 40, throttle channels 41, descender channels 42, connecting channels 43, the nozzles 45, four supply manifolds 46 (an example of "first common channel" of the present teaching), and three return manifolds 47 (an example of "second common channel" of the present teaching) are formed in the channel unit 21.

The pressure chambers 40 are formed in the plate 31. Each pressure chamber 40 has a substantially rectangular flat shape long in the conveyance direction. The pressure chambers 40 form a pressure chamber row 29 by being aligned in the paper-width direction. Moreover, twelve pressure chamber rows 29 are arranged in the conveyance direction. Moreover, positions of the twelve pressure chamber rows 29 differ in the paper-width direction.

The throttle channels 41 are formed to be spread over the plates 32 and 33. One throttle channel 41 is provided to each pressure chamber 40. The throttle channel 41 provided to each pressure chamber 40 forming the odd-numbered pressure chamber rows 29 from the upstream side of the conveyance direction is connected to an end portions on the upstream side of the conveyance direction of that pressure chambers 40, and is extended toward the upstream side of the conveyance direction from a connecting portion with that pressure chambers 40. The throttle channel 41 provided to each pressure chamber 40 forming the even-numbered pressure chamber rows 29 from the upstream side of the conveyance direction is connected to an end portion on the downstream side of the conveyance direction of the pressure chamber 40, and is extended toward the downstream side of the conveyance direction from connecting portion with that pressure chamber 40.

Each descender channel 42 is formed by through holes formed in the plates 32 to 37, overlapping in a vertical direction. One descender channel 42 is provided to each pressure chamber 40. The descender channel 42 provided to each pressure chamber 40 forming the odd-numbered pressure chamber rows 29 from the upstream side of the conveyance direction is connected to an end portion on the downstream side of the conveyance direction of that pressure chamber 40, and is extended downward from connecting portion with that pressure chamber 40. The descender channel 42 provided to each pressure chamber 40 forming the even-numbered pressure chamber rows 29 from the upstream side of the conveyance direction is connected to an end portion on the upstream side of the conveyance direction of that pressure chamber 40, and is extended downward from a connecting portion with that pressure chamber 40.

The connecting channels 43 are formed in the plate 37. Each connecting channel 43 is extended horizontally in a direction inclined with respect to the paper-width direction and the conveyance direction. Each connecting channel 43 connects lower end portions of two descender channels 42. The two descender channels 42 are connected to two pressure chambers 40 adjacent in the conveyance direction, respectively. To describe in further detail, through holes are formed in the plate 37. Each through hole is formed by a portion forming the two descender channels 42 and a portion forming the connecting channel 43.

Each nozzle 45 is formed in the plate 38. One nozzle 45 is provided to each connecting channel 43. Each nozzle 45 is connected to a central portion of the corresponding connecting channel 43.

Moreover, individual channels 28 are formed in the channel unit 21. Each individual channel has one nozzle 45, one connecting channel 43 which is connected to the nozzle 45, two descender channels 42 that are connected to the connecting channel 43, two pressure chambers 40 that are connected to the two descender channels 42, and two throttle channels 41 that are connected to the two pressure chambers 40. The individual channels 28 form an individual channel row 27 by being aligned in the paper-width direction. Moreover, in the channel unit 21, six individual channel rows 27 are arranged along the conveyance direction.

Each supply manifold 46 is formed by through holes formed in the plates 34 and 35 and recesses formed in a portion on an upper side of the plate 36 being overlapped vertically. Each supply manifold 46 is extended in the paper-width direction. The four supply manifolds 46 are arranged at an interval in the conveyance direction. Moreover, out of the four supply manifolds 46, the first supply manifold 46 from an upstream side of the conveyance direction corresponds to the first pressure chamber row 29 from the upstream side of the conveyance direction. The second supply manifold 46 from the upstream side of the conveyance direction corresponds to the fourth and fifth pressure chamber rows 29 from the upstream side of the conveyance direction. The third supply manifold 46 from the upstream side of the conveyance direction corresponds to the eighth and ninth pressure chamber rows 29 from the upstream side of the conveyance direction. The fourth supply manifold 46 from the upstream side of the conveyance direction corresponds to the twelfth pressure chamber row 29 from the upstream side of the conveyance direction. Each supply manifold is connected to the throttle channels 41 connected to the pressure chambers 40 forming the corresponding pressure chamber row 29. More specifically, each supply manifold 46 is connected to an end portion of each throttle channel 41, on an opposite side of the pressure chamber 40.

Each return manifold 47 is formed by through holes formed in the plates 34 and 35 and recesses formed in a portion on the upper side of the plate 36 being overlapped vertically. Each return manifold 47 is extended in the paper-width direction. The three return manifolds 47 are arranged between the adjacent supply manifolds 46 in the conveyance direction. Moreover, out of the three return manifolds 47, the first return manifold 47 from the upstream side of the conveyance direction corresponds to the second and third pressure chamber rows 29 from the upstream side of the conveyance direction. The second return manifold 47 from the upstream side of the conveyance direction corresponds to the sixth and seventh pressure chamber rows 29 from the upstream side of the conveyance direction. The third return manifold 47 from the upstream side of the conveyance direction corresponds to the tenth and eleventh pressure chamber rows 29 from the upstream side of the conveyance direction. Each return manifold 47 is connected to the throttle channels 41 connected to the pressure chambers 40 forming the corresponding pressure chamber row 29. More specifically, each return manifold 47 is connected to an end portion of each throttle channel 41, on the opposite side of the pressure chamber 40.

Moreover, each supply manifold 46, at a right-end portion in the paper-width direction, is extended in a vertical direction through the plates 31 to 36, and an upper end portion thereof is provided with an inflow port 46*a*. Four inflow ports 46*a* of the four supply manifolds 46 communicate mutually and are connected to an ink tank 71 via a pump for circulation 72 (hereinafter, "circulation pump 72"). The ink tank 71 is connected to an ink cartridge which is not depicted in the diagram, via a tube which is not depicted in the diagram, and an ink is supplied thereto from the ink cartridge.

Moreover, each return manifold 47, at a right-end portion in the paper-width direction, is extended in a vertical direction through the plates 31 to 36, and an upper end portion thereof is provided with an outflow port 47*a*. Three outflow ports 47*a* of the three return manifolds 47 communicate mutually and are connected to the ink tank 71.

As the circulation pump 72 is driven, the ink inside the ink tank 71 flows into each supply manifold 46 through each inflow port 46*a*. Moreover, the ink flows into the individual channels 28 from each supply manifold 46, and the ink flows out from the individual channels 28 to the corresponding return manifold 47. Furthermore, the ink inside each return manifold 47 flows out through each outflow port 47*a* and flows toward the ink tank 71. Accordingly, the ink circulates between the head unit 3 and the ink tank 71.

Here, a rotational speed of the circulation pump 72 is variable and the unit circulation amount which is an amount circulated of ink per unit time is variable in at least three stages. In the following description, setting (switching) the unit circulation amount to (each of) three stages sometimes will be described in order from the large unit circulation amount as "set (switch) the circulation amount to large", "set (switch) the circulation amount to medium", and "set (switch) the circulation amount to small". Moreover, the unit circulation amount when "the circulation amount is set to medium" is an amount not smaller than the minimum unit circulation amount that does not let the thickening of the ink inside the nozzle 45 to progress. Accordingly, the unit circulation amount when "the circulation amount is set to large" is larger than the minimum unit circulation amount. Whereas, the unit circulation amount when "the circulation amount is set to small" is smaller than the minimum unit circulation amount. For instance, the unit circulation amount when "the circulation amount is set to large" is about twice the unit circulation amount when "the circulation amount is set to medium". Moreover, the unit circulation amount when "the circulation amount is set to small" is about 60% of the unit circulation amount when "the circulation amount is set to medium". More specifically, for instance, the unit circulation amount when the circulation amount is set to large, the unit circulation amount when the circulation amount is set to medium, and the unit circulation amount when the circulation amount is set to small are about 10 [nl/sec], 5 [nl/sec], and 3 [nl/sec] respectively. Moreover, the electric power consumption when the circulation amount is set to large, the electric power consumption when the circulation amount is set to medium, and the electric power consumption when the circulation amount is set to small are 380~400 [W], 190~200 [W], and 110~120 [W] respectively.

Moreover, a damper chamber 49 is formed in the plate 37 to overlaps in the vertical direction with the supply manifold 46. The supply manifold 46 and the damper chamber 49 are separated in the vertical direction by a partition wall formed by a lower end portion of the plate 36. By the partition wall being deformed, a fluctuation in pressure of the ink inside the supply manifold 46 is suppressed. A damper chamber 48 is formed in the plate 37 to overlaps in the vertical direction with the return manifold 47. The return manifold 47 and the damper chamber 48 are separated in the vertical direction by a partition wall formed by a lower end portion of the plate 36. By the partition wall being deformed, a fluctuation in pressure of the ink inside the return manifold 47 is suppressed.

<Piezoelectric Actuator 22>

The piezoelectric actuator 22 includes two piezoelectric layers 61 and 62, a common electrode 63, and individual electrodes 64. The piezoelectric layers 61 and 62 are made of a piezoelectric material having lead zirconate titanate (PZT) which is a mixed crystal of lead titanate and lead zirconate, as a main component. The piezoelectric layer 61 is arranged on an upper surface of the channel unit 21, and the piezoelectric layer 62 is arranged on an upper surface of the piezoelectric layer 61. The piezoelectric layer 61, unlike the piezoelectric layer 62, may be made of an insulating material other than a piezoelectric material, such as a synthetic resin material.

The common electrode 63 is arranged between the piezoelectric layer 61 and the piezoelectric layer 62, and is extended continuously almost over the entire area of the piezoelectric layers 61 and 62. The common electrode 63 is kept at a ground electric potential. Each individual electrode 64 is provided to each pressure chambers 40. Each individual electrode 64 has a substantially rectangular flat shape long in the conveyance direction. Each individual electrode 64 is arranged to overlap in a vertical direction with a central portion of the corresponding pressure chamber 40. Moreover, an end portion of each individual electrode 64, on a side opposite to the descender channel 42 in the conveyance direction, is extended up to a position not overlapping with the pressure chamber 40, and a front-end portion thereof is a connecting terminal 64*a* for connecting to a wiring member which is not depicted in the diagram. The connecting terminals 64*a* of the individual electrodes 64 are connected to the driven IC 59 (refer to FIG. 5) via a wiring member which is not depicted in the diagram. Moreover, one of a ground electric potential and a predetermined drive electric potential (such as about 20 V) is selectively applied to each individual electrode 64 by the driver IC 59. Moreover, while the common electrode 63 and the individual electrodes 64 are arranged in such manner, correspondingly, portions of the piezoelectric layer 62 sandwiched between the individual electrodes 64 and the common electrode 63 are active portions which are polarized in a direction of thickness.

Here, a method of making the ink jet from the nozzles 45 by driving the piezoelectric actuator 22 will be described below. In the piezoelectric actuator 22, in the standby state in which no ink is jetted from the nozzles 45, all the individual electrodes 64 are kept at the ground electric potential same as the common electrode 63. For making the ink jet from a certain nozzle 45, the electric potential of the two individual electrodes 64 corresponding to the two pressure chambers 40 connected to that nozzle 45 is switched from the ground electric potential to a drive electric potential.

Accordingly, an electric field parallel to a polarization direction is generated in the two active portions corresponding to the two individual electrodes 64, and the two portions are contracted in a horizontal direction which is orthogonal to the polarization direction. Accordingly, a portion of the piezoelectric layers 61 and 62 overlapping in the vertical direction with the two pressure chambers 40 is deformed as a whole to form a projection toward the pressure chamber 40. As a result, a volume of the pressure chamber 40 becomes small, and a pressure on the ink inside the pressure chamber 40 rises up and the ink is jetted from the nozzle 45 communicating with the pressure chamber 40. Moreover, after the ink is jetted from the nozzle 45, the electric potential of the two individual electrode returns to the ground electric potential. Accordingly, the piezoelectric layers 61 and 62 return to a state before the deformation.

<Electrical Configuration of Printer 1>

Next, an electrical configuration of the printer 1 will be described below. As depicted in FIG. 5, the printer 1 includes a controller 50. The controller 50 includes a CPU (Central Processing Unit) 51, a ROM (Read Only Memory) 52, a RAM (Random Access Memory) 53, a flash memory 54, and an ASIC (Application Specific Integrated Circuit) 55, and controls an operation of the conveyance motor 57, the cap elevating mechanism 58, the driver IC 59, the head moving mechanism 56, the purge pump 13, and the circulation pump 72.

<Control of Printer 1>

Figure 6A:
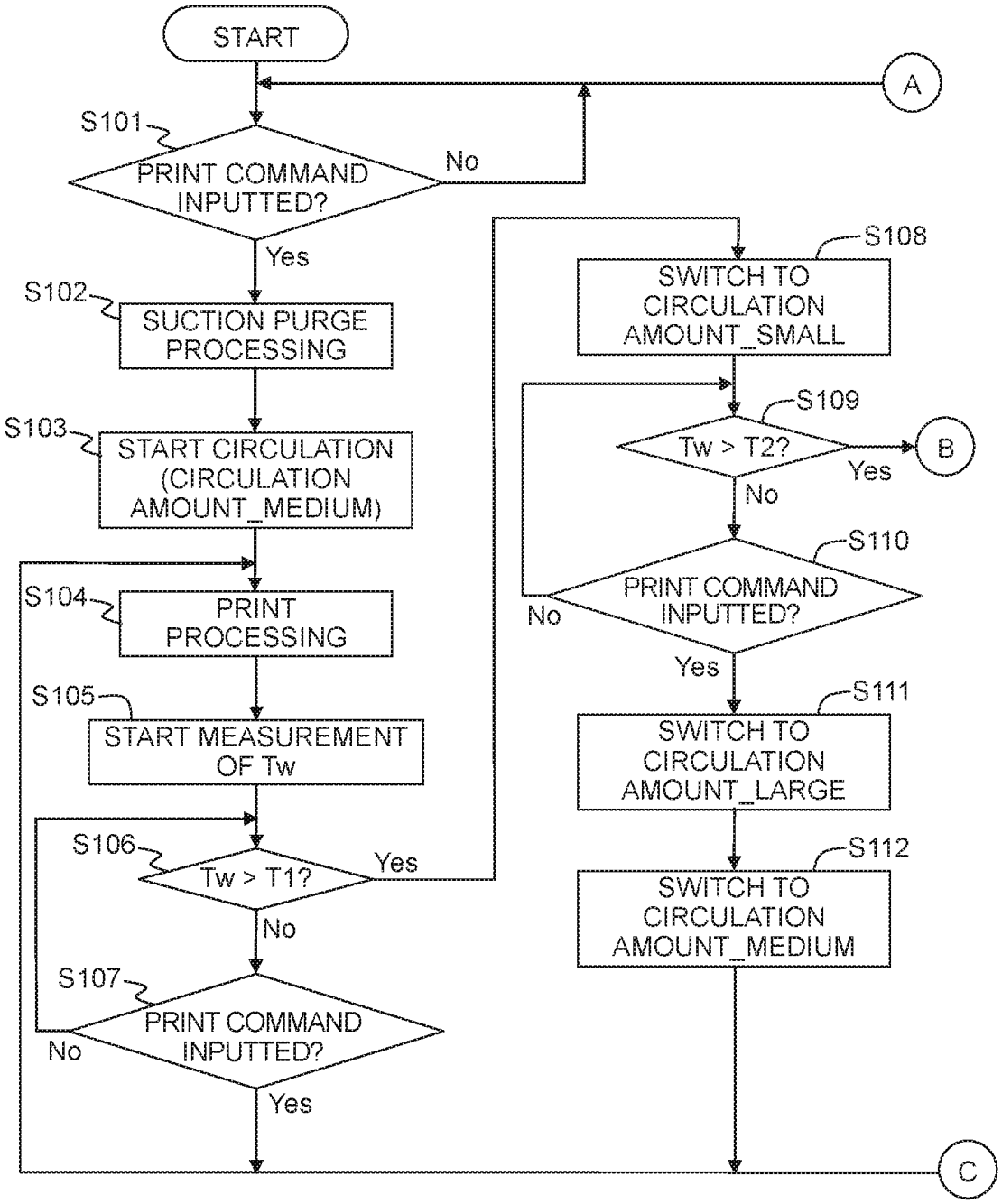
FIGS. 6A and 6B are a flowchart depicting a flow of control by a controller.
Figure 6B:
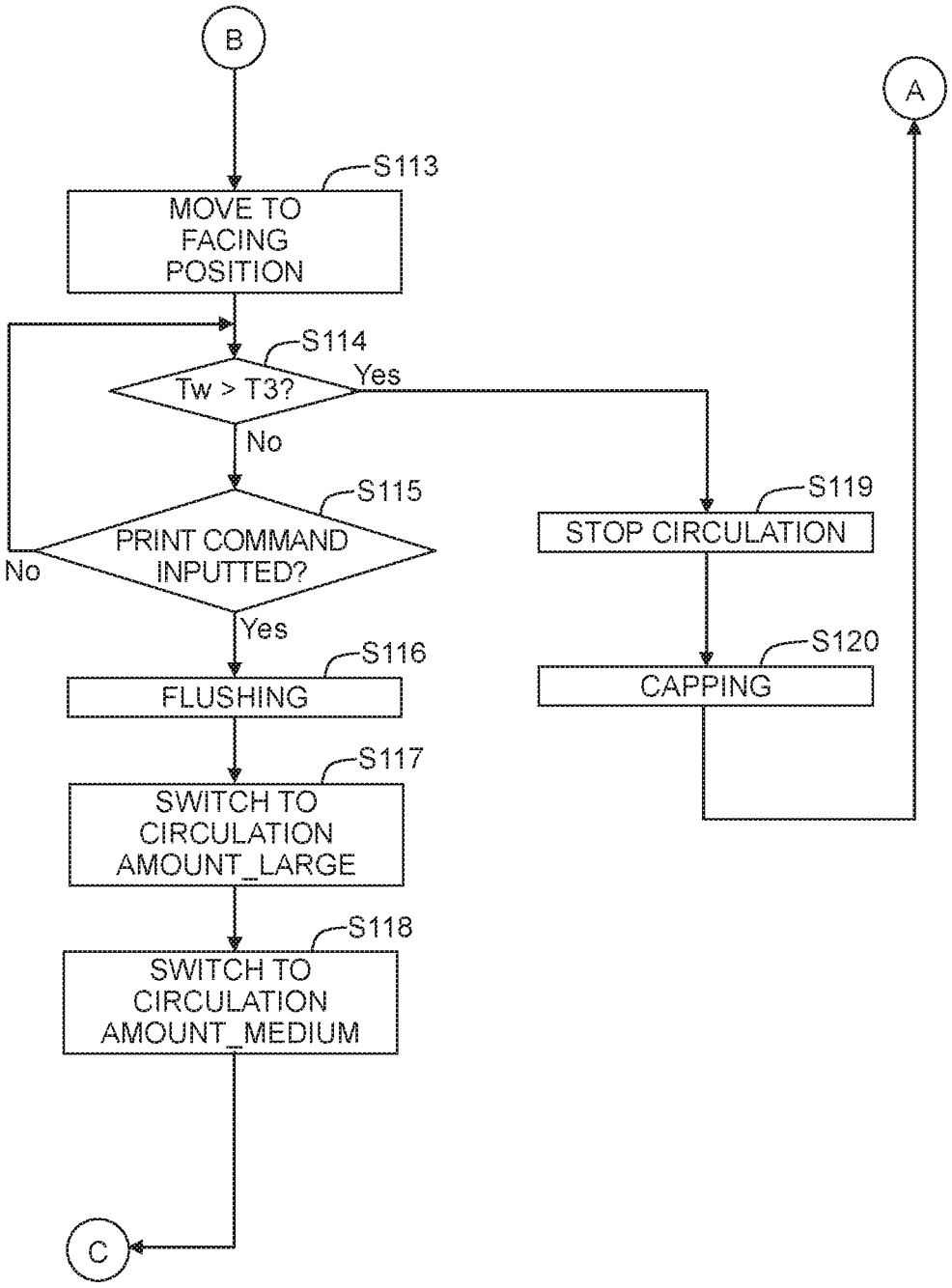

Next, a control of the printer 1 by the controller 50 will be described below. In the printer 1, the controller 50 carries out processing in accordance with a flow in FIG. 6. The flow in FIG. 6 starts when a power supply of the printer 1 is put ON.

As the power supply of the printer 1 is put ON, the controller 50 waits till a print command is input (NO at step S101). As the input command is input (YES at step S101), the controller 50 executes a suction purge processing of making carry out the suction purge (step S102). Thereafter, the controller 50, after starting circulation of the ink by the circulation pump 72 by setting the circulation amount to medium (step S103), executes a print processing of making carry out printing on a recording paper P as described above (step S104).

After the completion of the print processing, a measurement of a standby time Tw for which the standby state in which the head unit 3 is waiting without jetting the ink from the nozzle 45 continues, is started (step S105). Even at this stage, the controller 50 sets the circulation amount to medium and make the ink circulate.

Moreover, the controller 50, in a case in which the standby time Tw is not more than a first time T1 (NO at step S106), when the print command is not input (NO at step S10), waits in the same state. Whereas, when the print command is input (YES at step S107), the controller 50 returns the processing to step S104. Here, the first time T1 is about one minute for example.

Moreover, the controller 50, when the standby time Tw is more than the first time T1 (YES at step S106), switches to set the circulation amount to small and lowers the unit circulation amount (step S108). Moreover, the controller 50, in a case in which the standby time Tw is not more than a second time T2 (NO at step S109), when the print command is not input (NO at step S110), waits in the same state as it has been. Whereas, in a case in which the standby time Tw is not more than the second time T2 (NO at step S109), when the print command is input (YES at step S110), the controller 50 switches temporarily to "set the circulation amount to medium" and increases the unit circulation amount (step S111), and thereafter, switches to "set the circulation amount to medium (step S112), and returns the processing to step S104. Here, the second time T2 is about 30 minutes and the first time T1 is shorter than a difference [T2−T1] between the first time T1 and the second time T2.

Moreover, the controller 50, when the standby time Tw becomes more than the second time T2 (YES at step S109), moves the ink-jet head 2 to a facing position by the heat moving mechanism 56 and brings it to the facing state (step S113). At this stage, the nozzles 45 of each head unit 3 and the corresponding nozzle caps 11 are facing, but the nozzle caps 11 are in a state of being descended as they have been. In other words, each nozzle cap 11 is not covering the nozzles 45 of the corresponding head unit 3, and the nozzles 45 are in the uncapping state.

Next, the controller 50, in a case in which the standby time Tw is not more than a third time T3 (NO at step S114), when the print command is not input (NO at step S115), waits in the same state. Whereas, in a case in which the standby time Tw is not more than the third time T3 (NO at step S114), when the print command is input (YES at step S1115), the controller 50 controls the driver IC 59 and makes carry out flushing in which the ink is jetted from the nozzles 45 toward the nozzle caps 11 (step S116). Here, in a case in which the piezoelectric actuator 22 is driven at 20 kHz and a waveform signal which is input for one drive (for driving once) the piezoelectric actuator 22 includes two pulses and the number of nozzles in each head unit 3 is 1600 and the temperature is 25° C., the electric power consumption necessary for flushing is about 25~30 [W]. Moreover, after the flushing is carried out, the purge pump 13 is driven and the ink accumulated in the nozzle caps 11 is discharged.

Thereafter, the controller 50, by controlling the circulation pump 72 increases the unit circulation amount by switching temporarily to "set the circulation amount to large" (step S117), and thereafter switches to "set the circulation amount to medium" (step S118), and returns the processing to step S104. Here, the third time T3 is about 60 minutes, and the first time T1 is shorter than a difference [T3−T2] between the second time T2 and the third time T3.

Moreover, the controller 50, when the standby time Tw has becomes more than the third time T3 (YES at step S114), stops the circulation of ink by stopping the circulation pump 72 (step S119). Next, the controller 50 causes the cap elevating mechanism 58 make ascent the nozzle caps 11 (step S120) to be in the capping state, and returns the processing to S101. In a case in which the print command is input (YES at step S101) after the standby time Tw has become more than the third time T3, the controller 50 executes the suction purge processing (step S102), and thereafter, after starting the circulation of ink (step S103), executes the print processing (step S104).

[Effect]

When the ink is circulated between the head unit 3 and the ink tank 71, thickening of the ink inside the nozzles 45 is suppressed. At this time, when the ink is circulated by making the unit circulation amount large to an extent such that the thickening of ink inside the nozzles 45 does not progress (for example, by setting the circulation amount to medium), when the print command is input, it is not necessary to carry out the recovery operation for resolving the thickening of ink inside the nozzles 45, and it is possible to shift to the jetting operation immediately. However, in this case, for circulating a certain amount of ink all the time, the electric power consumption becomes high.

Therefore, in the present embodiment, in a case in which the standby time Tw is not more than the first time T1 and a possibility that the subsequent print command will be input immediately is high, the ink is circulated by setting the circulation amount to medium. Accordingly, when the print command is input, it is possible to shift to the jetting operation without carrying out the recovery operation of resolving the thickening of ink inside the nozzles 45. Accordingly, it is possible to shorten to minimum the time after the print command has been input till the jetting operation is started. Moreover, in a case in which the standby time Tw is not more the first time T1, there is no substantial increase in the electric power consumption even when the unit circulation amount is made large to an extent that the thickening of ink inside the nozzles 45 does not progress by setting the circulation amount to medium.

Whereas, in a case in which the standby time Tw is longer than the first time T1, the unit circulation amount is lowered predicting that the print command will not be input for a while. More specifically, in a case in which the standby time Tw is more than the first time T1 and is not more than the third time T3, the circulation amount is set to small. Whereas, in a case in which the standby time Tw becomes more than the third time T3, the circulation is stopped. Accordingly, it is possible to suppress the electric power consumption.

Figure 7:
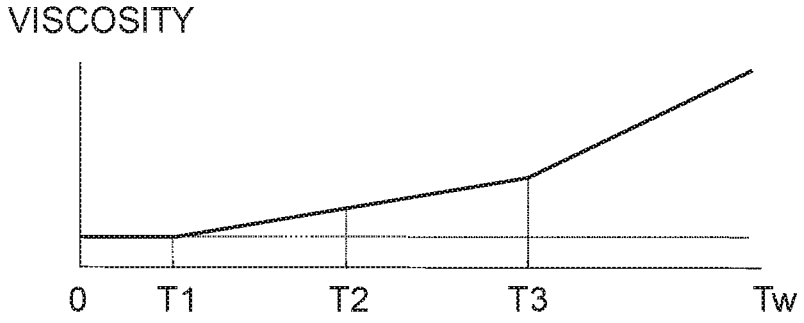
FIG. 7 is a diagram depicting a relationship between a standby time and a viscosity of ink inside a nozzle.

In a case of changing the unit circulation amount in this manner, as depicted in FIG. 7, during the period in which the standby time Tw is not more than the first time T1, there is almost no change in the viscosity of ink inside the nozzles 45. When the standby time Tw becomes more than the first time T1, and switched to "set the circulation amount to small", the viscosity of ink inside the nozzles 45 becomes higher gradually with the standby time Tw becoming more. Furthermore, when the standby time Tw becomes more than the third time T3, and the circulation of ink is stopped, the viscosity of ink inside the nozzles 45 becomes further higher with elapsing of the standby time Tw.

Therefore, in the present embodiment, when the print command is input in the standby state, in accordance with the standby time at that point of time, whether or not to carry out the recovery operation of resolving the thickening of ink inside the nozzles 45 is determined before starting the jetting operation, and in a case of carrying out the recovery operation, the type of the recovery operation is determined.

More specifically, in a case in which the standby time Tw is not more than the first time T1, the recovery operation is not carried out. Moreover, in a case in which the standby time Tw is more than the first time T1, and is not more than the second time T2, the thickening of ink inside the nozzles 45 is resolved by increasing the unit circulation amount by temporarily setting the circulation amount to large. In this case, about 10 seconds are necessary after the print command has been input till the jetting operation can be carried out.

Moreover, in a case in which the standby time Tw becomes more that the second time T2 and is not more than the third time T3, the thickening of ink inside the nozzles 45 is resolved by increasing the unit circulation amount by temporarily setting the circulation amount to large upon carrying out the flushing. In this case, about 10 more seconds are necessary for the flushing in addition to the abovementioned 10 seconds, after the print command has been input till the jetting operation can be carried out. In other words, the time required for the recovery operation becomes more than the time required in the case in which the standby time Tw becomes more than the first time T1, and not more than the second time T2.

Moreover, in a case in which the standby time Tw becomes more than the third time T3, the thickening of ink inside the nozzles 45 is resolved by the suction purge. In this case, about one to two minutes are necessary after the print command has been input till the jetting operation can be carried out. In other words, the time required for the recovery operation becomes even more than the time required in the case in which the standby time Tw has become more than the second time T2 but not more than the third time T3.

Moreover, in the present embodiment, in order to cope with the flushing which is carried in a case in which the print command is input in a state in which the standby time has become more than the second time T2 but not more than the third time T3, when the standby time Tw has become more than the second time T2, the ink-jet head 2 is moved to the facing position. Accordingly, it is possible to carry out the flushing immediately, and to shorten the time after the print command has been input till the jetting operation is started.

Moreover, in the present embodiment, in a case in which the standby time Tw is not more than the third time T3, the nozzle cap 11 is maintained in the uncapping state. Accordingly, at the time of shifting the head unit 3 from the standby state to the jetting operation, an operation of switching from the capping state to the uncapping state by making the nozzle caps 11 descent becomes unnecessary. Consequently, it is possible to shorten the time after the print command has been input till the jetting operation is started. In the uncapping state, the viscosity of ink inside the nozzle 45 is susceptible to become higher than the viscosity in the capping state. Therefore, when the uncapping state is let to be assumed, the increase in the viscosity of ink inside the nozzles 45 is suppressed by circulating the ink inside the head unit 3.

Whereas, when the standby time Tw becomes more than the third time T3, the circulation of ink inside the head unit 3 is stopped. Consequently, the increase in the viscosity of ink inside the nozzles 45 is suppressed by letting the nozzle caps 11 to be in the capping state.

Moreover, in the present embodiment, the first time T1 is let to be an adequately short time with respect to the difference [T2−T1] between the first time T1 and the second time T2 and the difference [T3−T2] between the second time T2 and the third time T3. Accordingly, the print processing is terminated, and after the standby state is assumed, in a case of shifting to the jetting operation upon the subsequent print command is input immediately, it is possible to shorten the time after the print command has been input till starting the jetting operation. Moreover, in a case in which the standby time Tw has become even little more, it is possible to suppress the electric power consumption efficiently by reducing the unit circulation amount.

[Modified Examples]

The embodiment of the present teaching has been described heretofore. However, the present teaching is not restricted to the abovementioned embodiment, and various modifications are possible without departing from the scope of present teaching.

Figure 8A:
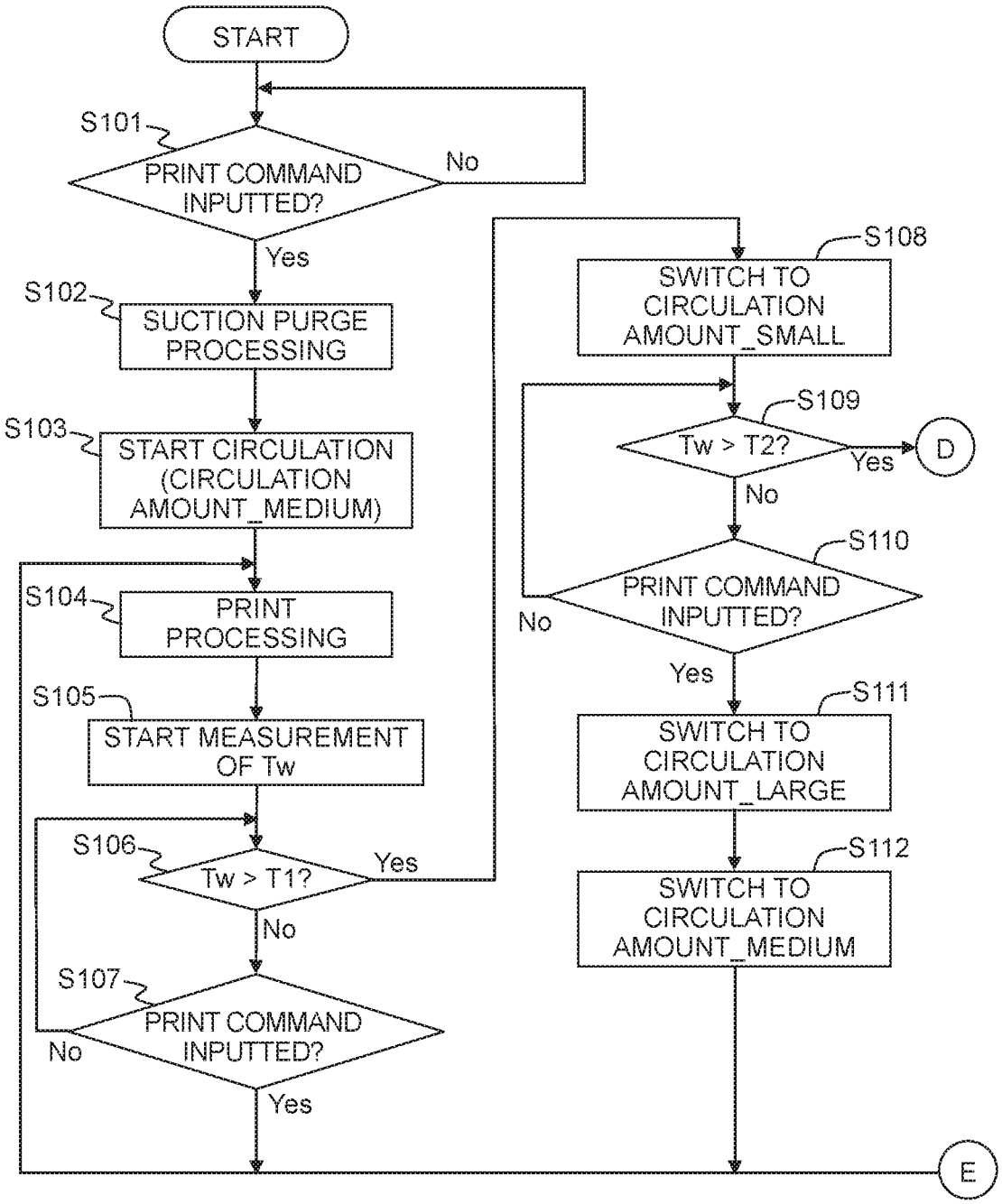
FIGS. 8A and 8B are a flowchart depicting a flow of control by a controller in a modified example 1.
Figure 8B:
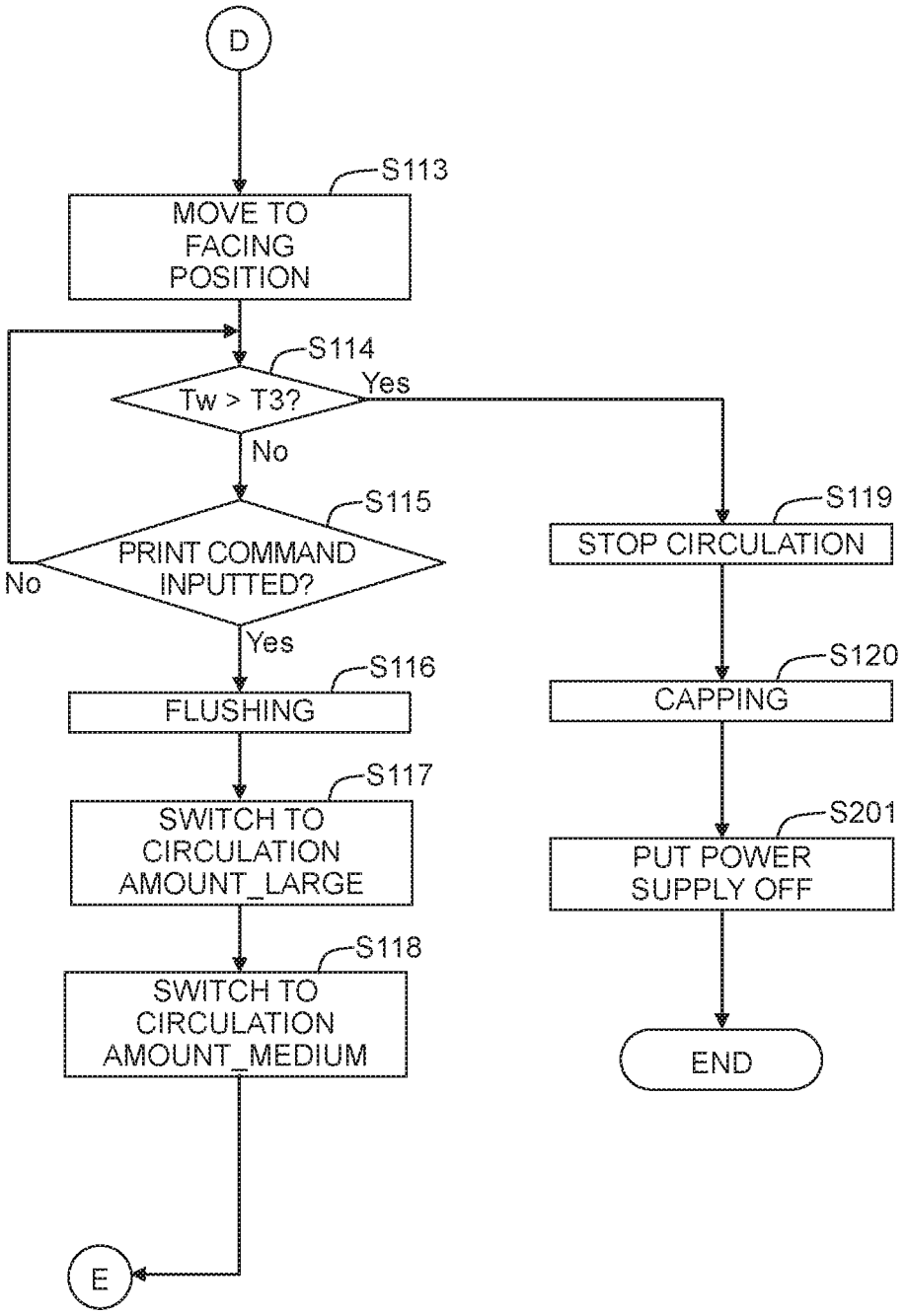

For instance, in the abovementioned embodiment, the control was carried out such that the processing returns to step S101 after the nozzle caps 11 were let to be in the capping state at step S120. However, the arrangement is not restricted to such arrangement. For instance, in a modified example 1 as depicted in FIG. 8, the controller 50 executes the processing from step S101 up to step S120 similarly as in the abovementioned embodiment. However, in the modified example 1, after the capping state is let to be assumed at step S120, instead of returning the processing to step S101, the power supply of the printer 1 is put OFF (step S201), and the processing is terminated.

In the modified example 1, when the standby time Tw has become more than the third time T3, and the ink-jet head 2 is not to be used for a long period of time, it is possible to suppress the electric power consumption by putting the power supply OFF. In a case of the modified example 1, at the time of carrying out printing by the printer 1 after the standby time Tw has become more than the third time T3, the power supply of the printer 1 is put ON, and a flow in FIG. 8 is started. Moreover, the controller 50, when the print command is input (YES at step S101), executes the suction purge processing (step S102), and thereafter, executes the print processing (step S104) after starting the circulation of ink (step S103).

Moreover, in the present embodiment, when the standby time Tw has become more than the third time T3, only the circulation of ink was to be stopped and the capping state was let to be assumed. However, the processing is not restricted to the abovementioned processing.

Figure 9A:
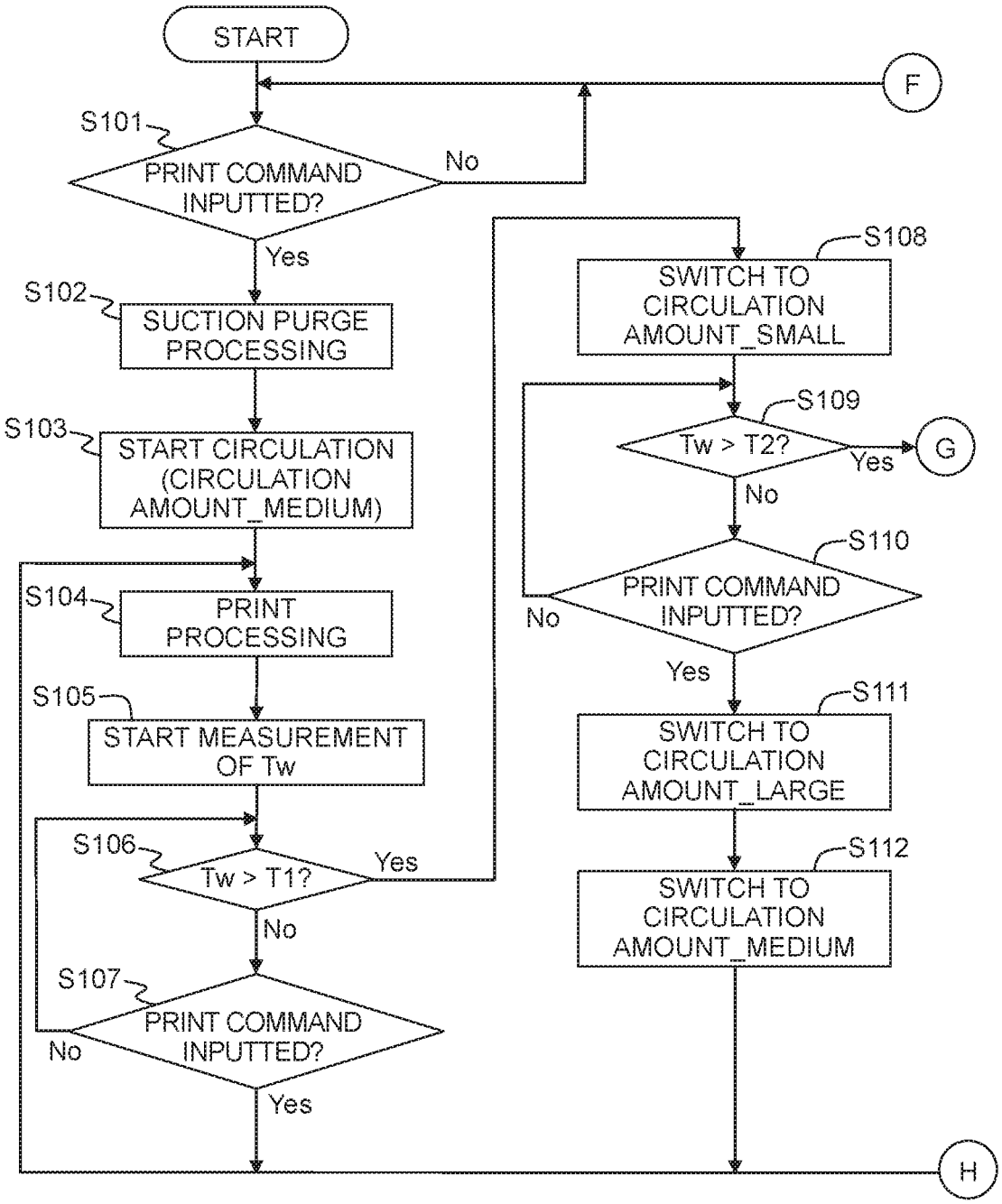
FIGS. 9A and 9B are a flowchart depicting a flow of control by a controller in a modified example 2.
Figure 9B:
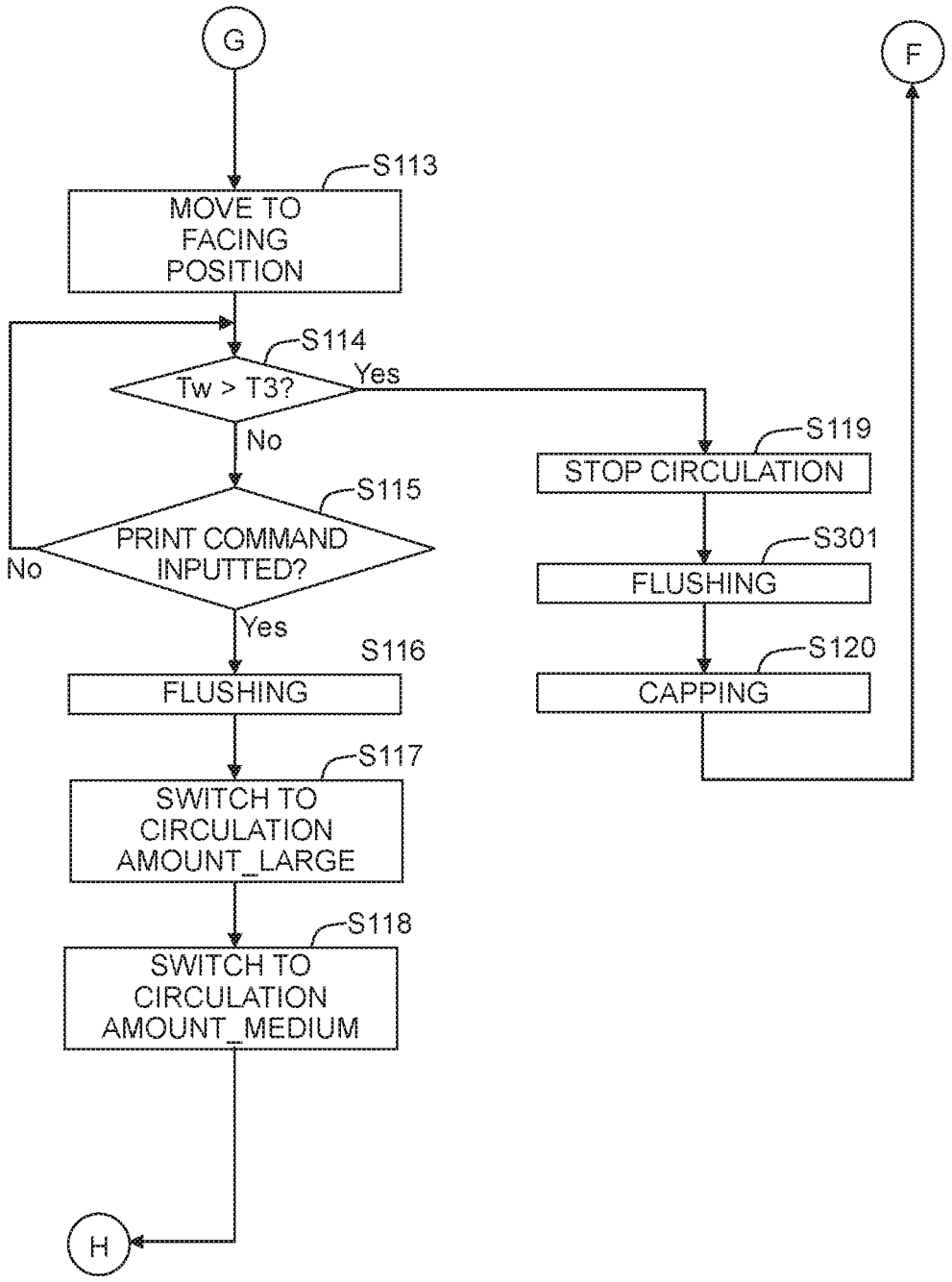

For instance, in a modified example 2 depicted in FIG. 9, the controller 50 executes processing from step S101 up to step S118 similarly as in the abovementioned embodiment. Moreover, the controller 50, when the standby time Tw has become more than the third time T3 (YES at step S114), stops the circulation of ink (step S119) similarly as in the abovementioned embodiment. Thereafter, the controller 50, after making carry out the flushing (step S301), lets the nozzle caps 11 to be in the capping state (step S120) similarly as in the abovementioned embodiment and returns the processing to step S101.

Figure 10A:
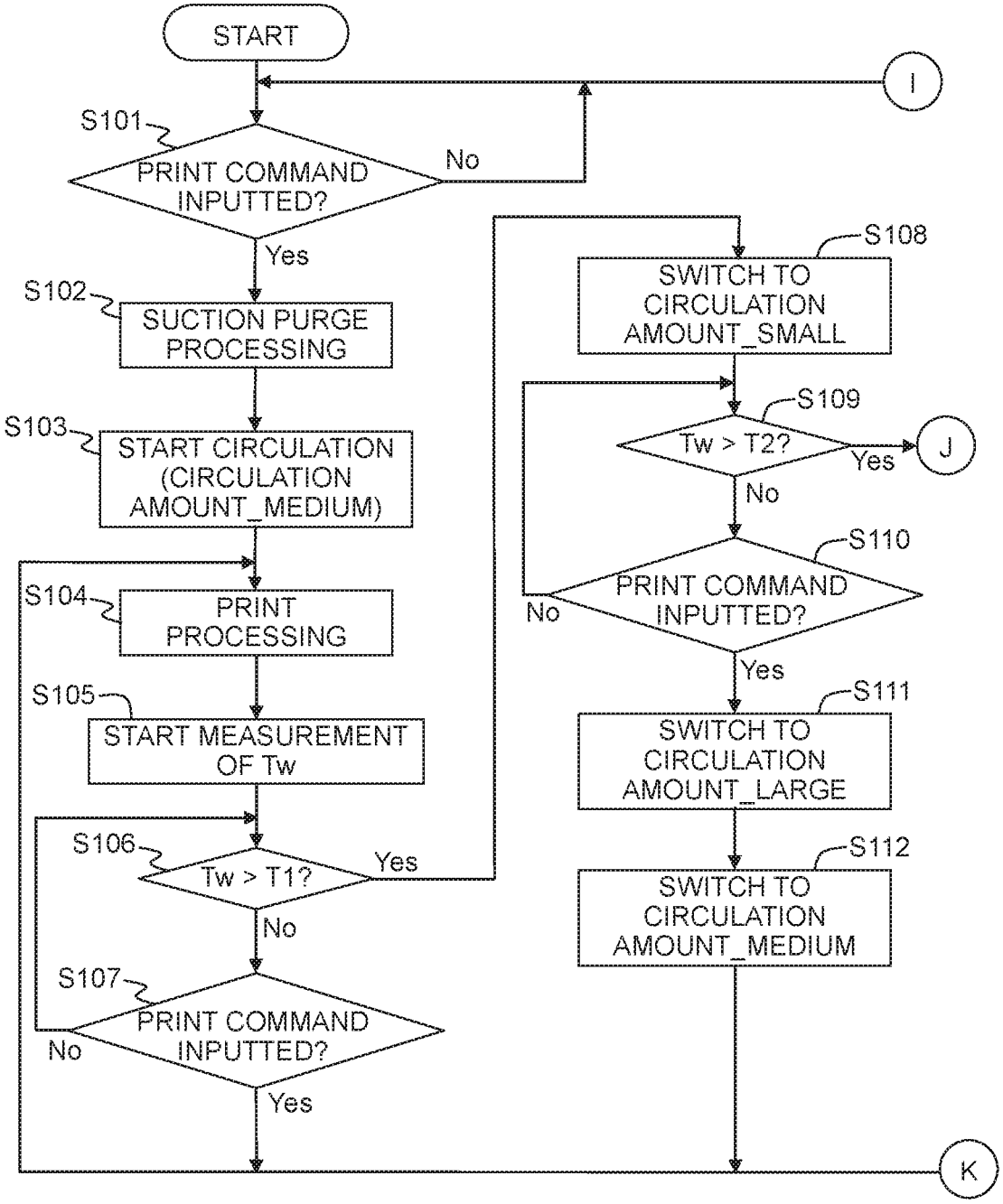
FIGS. 10A and 10B are a flowchart depicting a flow of control by the controller in a modified example 3.
Figure 10B:
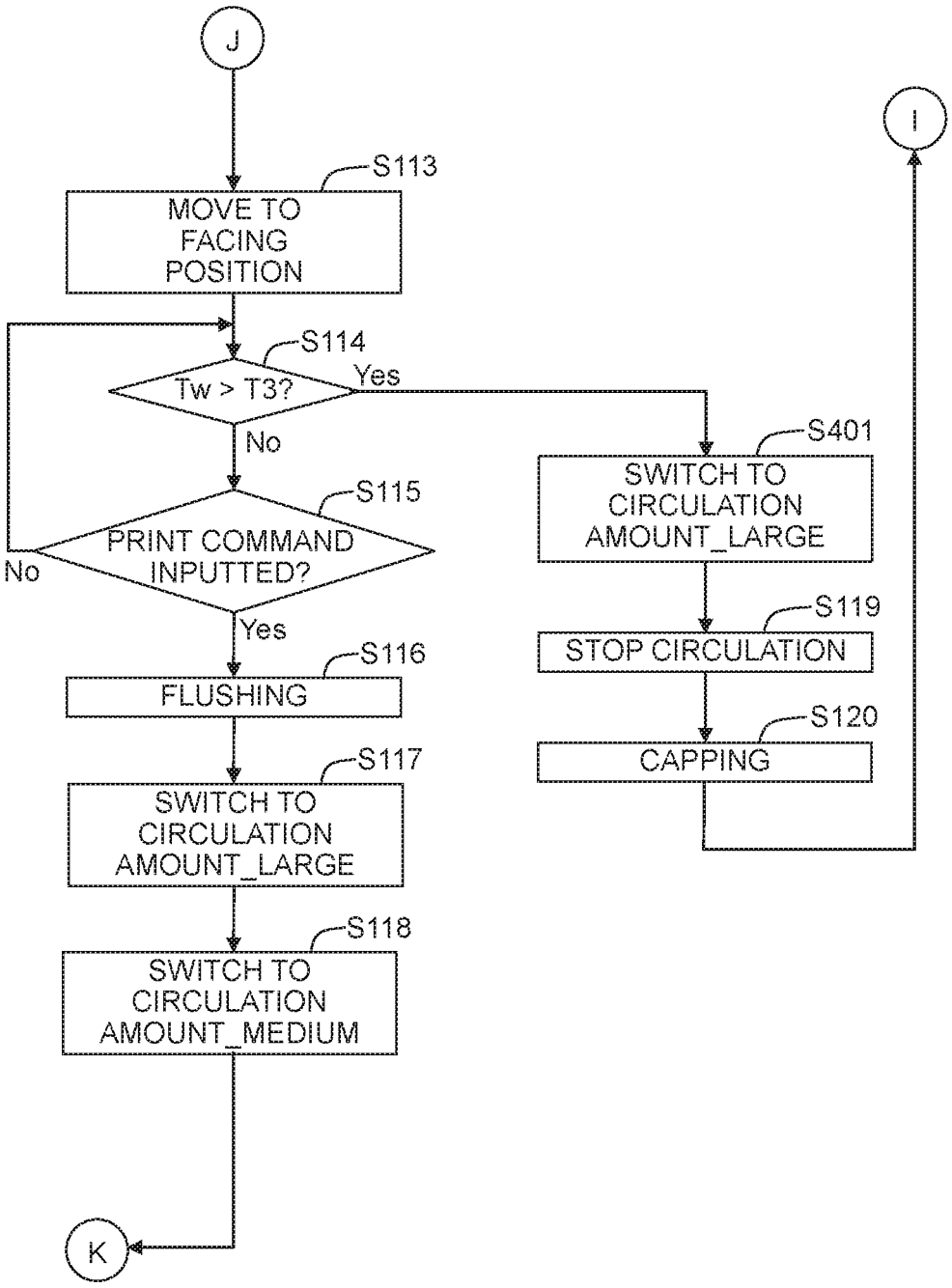

In a modified example 3 depicted in FIG. 10, the controller 50, executes the processing from step S101 up to step S118 similarly as in the abovementioned embodiment. Moreover, the controller 50, when the standby time has become more than that the third time t3 (YES at step S114), after switching the circulation amount to large temporarily (step S401) stops the circulation (step S401), and stops the circulation (step S119). Thereafter, the controller 50 lets the nozzle caps 11 to be in the capping state (step S120), and returns the processing to step S101.

Figure 11:
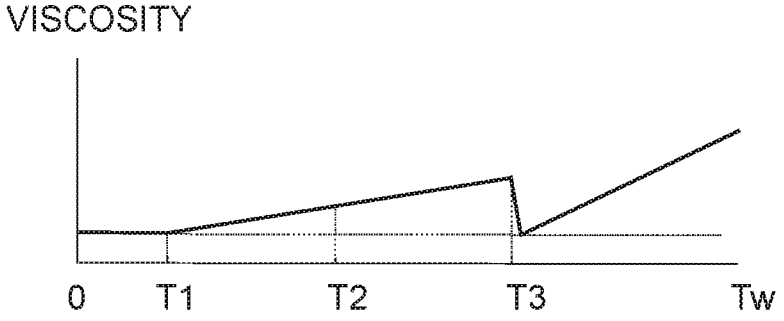
FIG. 11 is a diagram depicting a relationship between the standby time and the viscosity of ink inside the nozzle in the modified examples 2 and 3.

In the modified examples 2 and 3, as depicted in FIG. 11, in a case in which the standby time Tw has become more than the third time T3, either the flushing is carried out or, after resolving the thickening of ink inside the nozzles 45 by increasing the unit circulation amount temporarily, the state is switched from the uncapping state to the capping state. Accordingly, thereafter, it is possible to lower to minimum the thickening of ink inside the nozzle 45 when the print command has been input, and to shorten to minimum the time necessary for the suction purge.

Moreover, in the modified example 3, the circulation amount was temporarily switched to large, and thereafter, the capping state was let to be assumed after stopping the circulation. However, the arrangement is not restricted to such arrangement, and the circulation amount may be temporarily switched to large, and thereafter, the circulation may be stopped. Moreover, at step S401, the circulation amount may be temporarily switched to medium instead of temporarily switching the circulation amount to large. However, in this case, after temporarily switching the circulation amount to medium, it is preferable to make the time till stopping the circulation even longer.

Moreover, in the abovementioned embodiment, the nozzle caps 11 which cover the nozzles 45 also serve as an ink tray which receives the ink jetted through the nozzles 45 by flushing. However, the arrangement is not restricted to such arrangement and the printer 1 may include an ink tray which receives the ink discharged from the nozzles 45 by flushing, separately from the nozzle caps 11.

Moreover, in the abovementioned embodiment, in a case in which the standby time Tw becomes more than the third time T3, the nozzle caps 11 were switched from the uncapping state to the capping state. However, the arrangement is not restricted to such arrangement and the nozzle caps 11 may be switched from the uncapping state to the capping state at a different time after the ink-jet head 2 has been moved to the facing position at step S113.

Moreover, in the abovementioned embodiment, the ink-jet head 2 and the nozzle caps 11 were moved relatively in the vertical direction by making the nozzle caps 11 ascend and descend by the cap elevating mechanism 58, and the state was switched to the capping state and the uncapping state. However, the arrangement is not restricted to such arrangement, and the state may be switched to the capping state and the uncapping state by making the ink-jet head 2 ascend or descend or by making both the ink-jet head 2 and the nozzle caps 11 ascend and descend.

Moreover, in the abovementioned embodiment, in the case in which the standby time Tw becomes more than the third time T3, the circulation was stopped. However, the arrangement is not restricted to such arrangement, and arrangement may be made such that in the case in which the standby time Tw becomes more than the third time T3, the unit circulation amount is further reduced to an amount smaller than the amount when the circulation amount was set to small.

Moreover, in the abovementioned embodiment, in the case in which the standby time Tw becomes more than the second time T2, the ink-jet head 2 was moved to the facing position. However, the arrangement is not restricted to such arrangement, and an arrangement may be made such that in the case in which the standby time Tw has become more than the second time T2 (YES at step S109), the processing advances to step S114 with the ink-jet head 2 maintained at the print position as it has been, and thereafter, when the print command is received (YES at step S115), the flushing at step S116 may be carried out after the ink-jet head 2 has been moved to the facing position.

Moreover, in the abovementioned embodiment, the facing state and the non-facing state are switched by moving the ink-jet head 2 and the nozzle caps 11 relatively in the paper-width direction by moving the ink-jet head 2 in the paper-width direction by the head moving mechanism 56. However, the arrangement is not restricted to such arrangement and the facing state and the non-facing state may be switched either by moving the nozzle caps 11 in the paper-width direction or by moving both the ink-jet head 2 and the nozzle caps 11 in the paper-width direction.

Figure 12A:
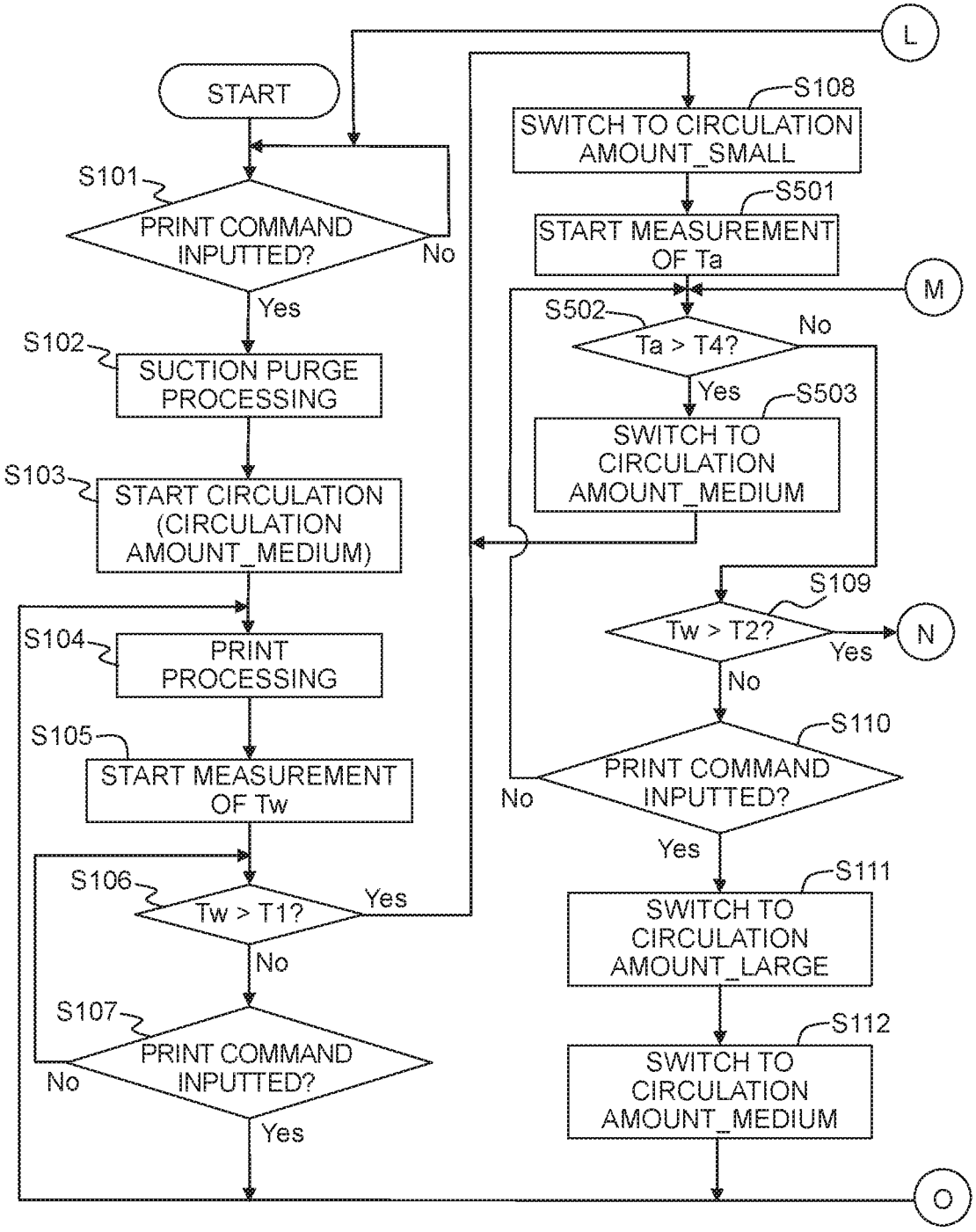
FIGS. 12A and 12B are a flowchart depicting a flow of control by a controller in a modified example 4.
Figure 12B:
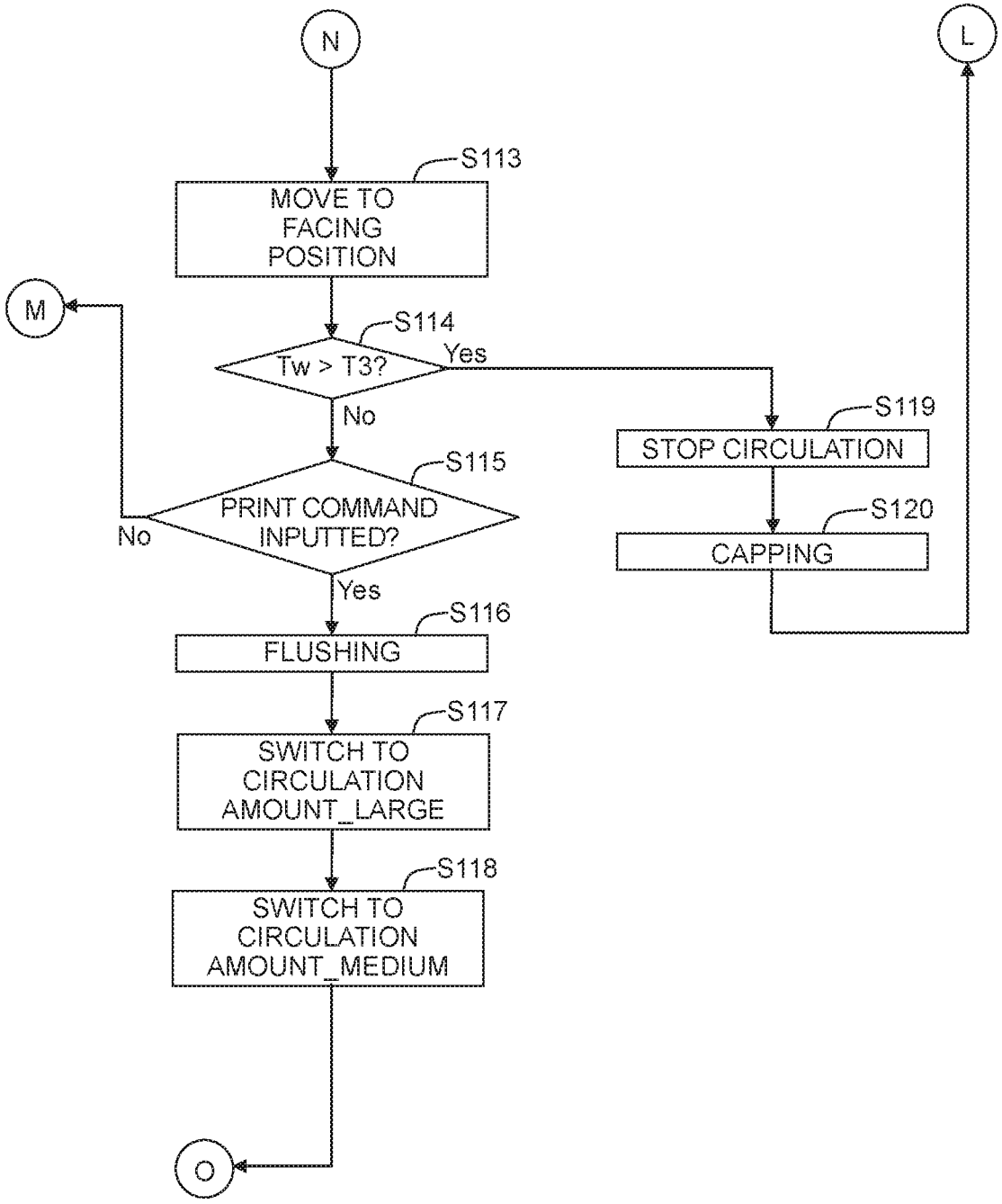

Moreover, in the abovementioned embodiment, in the case in which the standby time Tw became more than the first time T1, the circulation amount was switched to small, and thereafter, during the time till the standby time became more than the third time T3, the state of the circulation amount (set to) small was maintained. However, the arrangement is not restricted to such arrangement. For instance, in a modified example 4 depicted in FIG. 12, the controller 50 executes processing from step S101 up to step S108 similarly as in the abovementioned embodiment. Moreover, measurement of duration Ta for which the state of the circulation amount set to small continues is started (step S501) after switching to (set the) circulation amount to small at step S108. Moreover, the controller 50, in a case in which the duration Ta is not more than a predetermined time T4 (NO at step S502), makes the processing advance to step S109. Here, the predetermined time T4 is a time (about six minutes for example) shorter than the difference [T3−T1] between the third time T3 and the first time T1.

Whereas, in a case in which the duration Ta becomes more than the predetermined time T4 (YES at step S502), the controller 50, temporarily (for about four minutes for example), after increasing the unit circulation amount by switching to set the circulation amount to medium (step S503), returns the processing to step S108 (switches to set the circulation amount to small). In such manner, in a modified example 4, after the standby time T4 has become more than the first time T1 and the unit circulation amount is lowered, the unit circulation amount that has been lowered is increased temporarily every time the duration T4 is elapsed. Moreover, in the modified example 4, the controller 50, in a case in which the standby time Tw has become more than the second time T2 (YES at step S109), but not more than the third time T3 (NO at step S114), when the print command is not input (NO at step S115), instead of returning the processing to step S114, returns the processing to step S502.

Figure 13:
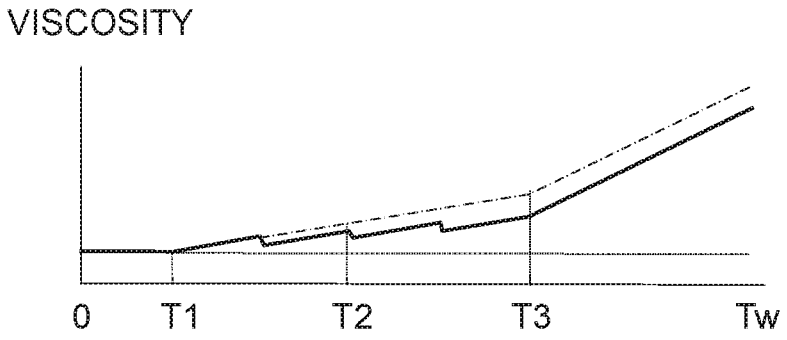
FIG. 13 is a diagram depicting a relationship between the standby time and the viscosity of ink inside the nozzle of the modified example 4.

In the modified example 4 depicted in FIG. 13, by being switched to set the circulation time to small after the standby time Tw has become more than the first time T1, the viscosity of ink inside the nozzles 45 becomes high. However, every time the duration T4 is elapsed, it is temporarily switched to set the circulation amount to medium and the viscosity of ink inside the nozzles 45 is lowered. Accordingly, although the electric power consumption increases to some extent, in a case in which the standby time Tw has become more than the first time T1 and not more than the third time T3, it is possible to suppress the increase in the viscosity of ink inside the nozzles 45. In FIG. 13, for the purpose of reference, a relationship between the standby time Tw and the viscosity of ink inside the nozzles 45 in the case of the abovementioned embodiment is depicted by an alternate dotted and dashed line.

Moreover, in a state in which the standby time Tw has become more than the first time T1 but not more than the second time T2, in a state in which the standby time Tw has becomes more than the second time T2 but not more than the third time T3, and in a state in which the standby time Tw has become more than the third time T3, in a case in which the print command is input and the head unit 3 is shifted from the standby state to the jetting operation, the recovery operation which is to be carried out in accordance with the standby time Tw is not restricted to the recovery operation described above. The more the standby time Tw, a recovery operation different from the recovery operation in the abovementioned embodiment may be let to be carried out provided that an arrangement has been made such that a recovery operation in which the thickening of ink inside the nozzles 45 is resolved highly effectively is made to be carried out.

Moreover, the arrangement is not restricted to an arrangement of changing the recovery operation by shifting the head unit 3 from the standby state to the jetting state in any of the abovementioned three states. A recovery operation in mode different from the recovery operation in the abovementioned embodiment may be let to be carried out in accordance with the standby time Tw at the time of shifting from the standby state to the jetting operation, provided that, the recovery operation in which the thickening of ink inside the nozzles 45 is resolved highly effectively when the head unit 3 is shifted from the standby state to the jetting state in which the standby time Tw is as long as possible is carried out.

Moreover, in the abovementioned embodiment, in the case in which the print command was input in a state of the standby time Tw not more than the first time T1, the head unit 3 was shifted to the jetting operation without carrying out the recovery operation. However, the arrangement is not restricted to such arrangement. When the ink is circulated by setting the circulation amount to medium, thickening of the overall ink inside the nozzles 45 does not progress but there is a possibility that of the ink inside the nozzles 45, some ink is thickened at a portion near a meniscus which is exposed to an exterior. Therefore, in the case in which the print command is input in the state of the standby time Tw not more than the first time T1, a non-jetting flushing in which the ink inside the nozzles 45 is made to vibrate by driving the piezoelectric actuator 22 by the driver IC 59 temporarily (for about one to three seconds for example) to an extent that no ink is jetted from the nozzle 45 may be carried out. In such manner, the head unit 3 may be shifted to the jetting operation while stirring the ink inside the nozzles 45.

Or, from a viewpoint of suppressing the electric power consumption, the unit circulation amount in the state of the standby time Tw not more than the first time T1 may let to be a unit circulation amount between the unit circulation amount when the circulation amount is set to medium (the unit circulation amount at the time of printing) and the unit circulation amount when the circulation amount is set to small. Moreover, in the case in which the print command is input in the state of the standby time Tw not more than the first time T1, the head unit 3 may be shifted to the jetting operation after resolving the thickening of ink near the meniscus by switching the circulation amount to large, and thereafter, setting the circulation amount to medium for a time shorter than that at step S112 for instance.

Moreover, in the embodiments described above, at the time of circulating the ink, the non-jetting flushing in which the ink inside the nozzles 45 made to vibrate may be carried out by driving the piezoelectric actuator 22 by the driver IC 59 to an extent such that the ink is not jetted from the nozzles 45. The larger the unit circulation amount, a drive frequency of the piezoelectric actuator 22 for the non-jetting flushing may be made high corresponding to the larger unit circulation amount. For instance, for the circulation amount (set to) large, the circulation amount (set to) medium, and the circulation amount (set to) small, the drive frequency of the piezoelectric actuator 22 for the non-jetting flushing may be let to be 32 [kHz], 16 [kHz], and 8 [kHz] respectively. The larger the unit circulation amount, the larger is the amount of ink that flows near the nozzles 45 per unit time. Therefore, by making the drive frequency of the piezoelectric actuator 22 for the non-jetting flushing high corresponding to the large unit circulation amount as described above, it is possible to let the ink stirred (agitated) inside the nozzles 45 to flow efficiently by letting the ink join the flow of ink near the nozzles 45. Or, the drive frequency of the piezoelectric actuator 22 for the non-jetting flushing may be let to be constant all the time.

Moreover, in the abovementioned embodiment, the first time T1 was shorter than the difference [T2−T1] between the first time T1 and the second time T2, and the difference [T3−T2] between the second time T1 and the third time T3. However, the arrangement is not restricted to such arrangement, and the first time T1 may be not shorter than the difference [T2−T1] and not shorter than the difference [T3−T2].

Moreover, in the abovementioned embodiment, the period in which the standby time Tw was not more than the first time T1, the circulation amount was set to medium, the period in which the standby time Tw became more than the first time T1 and not more than the third time T3, the circulation amount was set to small, and in a case in which the standby time Tw became more than the third time T3, the circulation was stopped, thus changing the unit circulation amount in three stages. However, the arrangement is not restricted to such arrangement. If the unit circulation amount becomes small as the standby time Tw becomes even more, the unit circulation amount may be lowered in stages such as in two stages and in four or more than four stages in accordance with the standby time Tw.

Figure 14B:
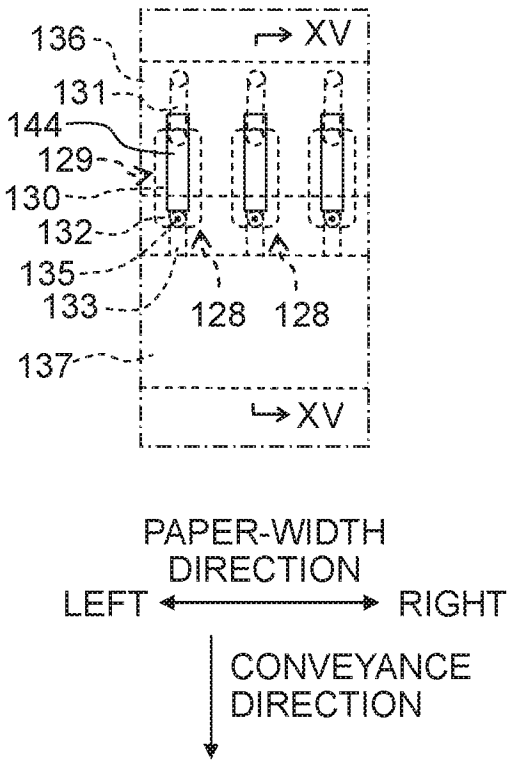
FIG. 14B is an enlarged view of a portion surrounded by alternate long and short dashed lines in FIG. 14A.
Figure 14A:
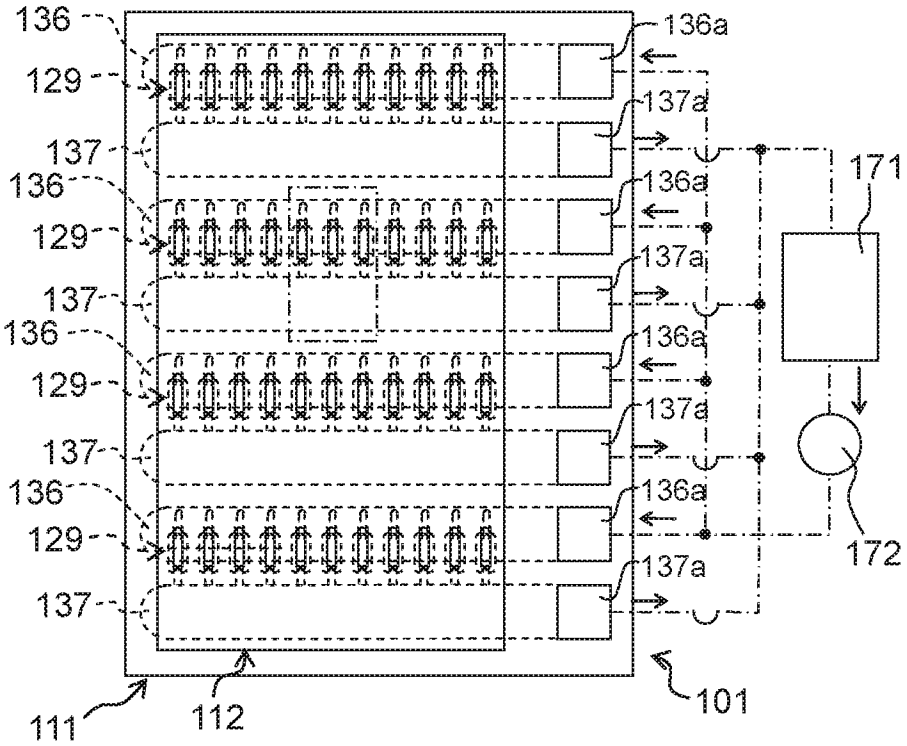
FIG. 14A is a plan view of an ink-jet head in a modified example 5.
Figure 15:
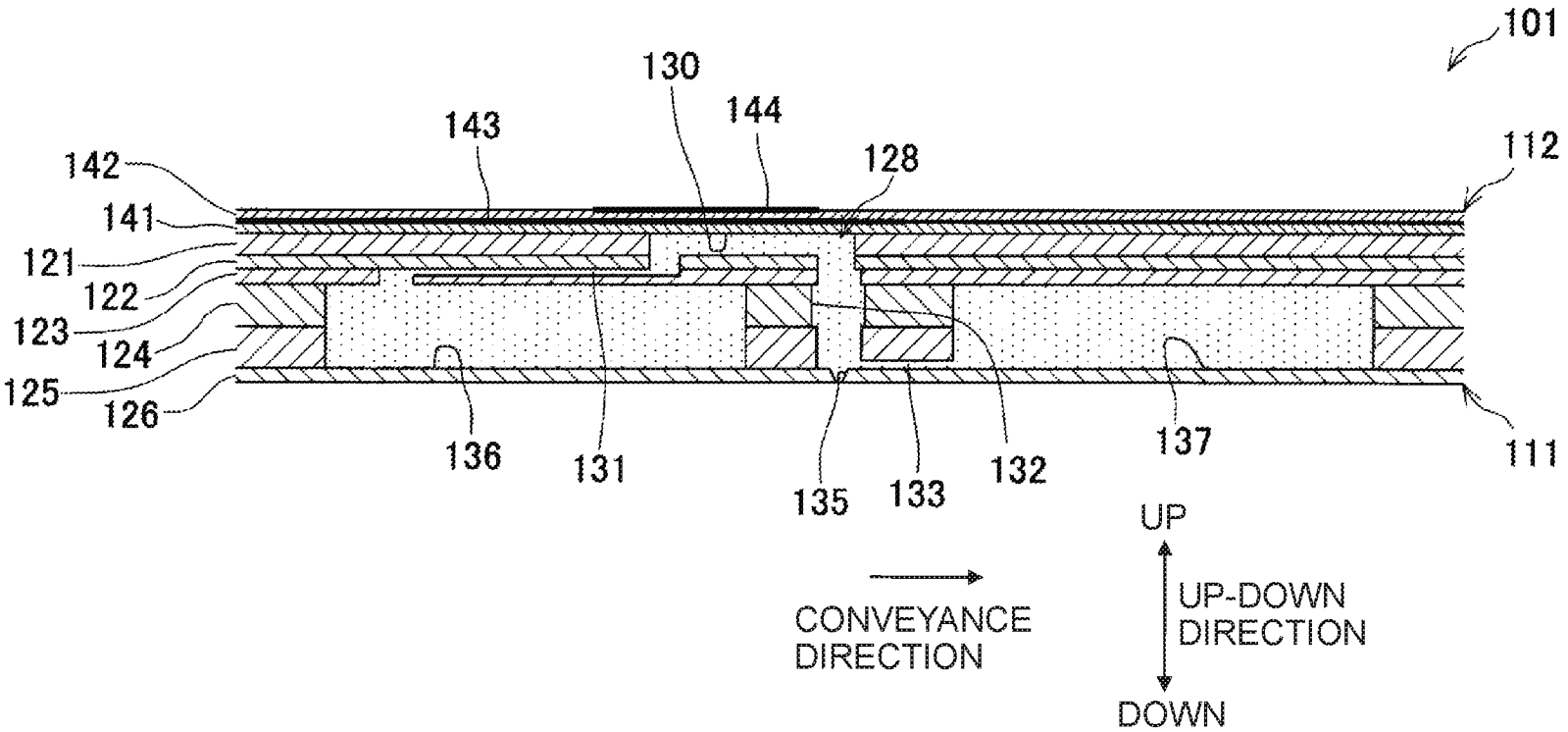
FIG. 15 is a cross-sectional view along a line XV-XV in FIG. 14B.

Moreover, in the abovementioned examples, one individual channel had two pressure chambers 40 communicating with one nozzle 45. However, the arrangement is not restricted to such arrangement. In a modified example 5 depicted in FIG. 14A, FIG. 14B, and FIG. 15, a head unit 101 includes a channel unit 111 and a piezoelectric actuator 112 as depicted in FIG. 14A, FIG. 14B, and FIG. 15.

<Channel Unit 111>

The channel unit 111 is formed by six plates 121 to 126 being stacked in this order from the top. Pressure chambers 130, throttle channels 131, descender channels 132, return channels 133, nozzles 135, four supply manifolds 136 (an example of "first common channel" of the present teaching), and four return manifolds 137 (an example of "second common channel" of the present teaching) are formed in the channel unit 111.

The pressure chambers 130 are formed in the plate 121. The pressure chamber 130 has a shape similar to the shape of the pressure chamber 40. Each throttle channel 131 is formed to be spread over the plates 122 and 123. One throttle channel 131 is provided to each pressure chamber 130. Each throttle channel 131 is connected to an end portion of the corresponding pressure chamber 130, on an upstream side of the conveyance direction, and is extended from a connecting portion with the corresponding pressure chamber 130 toward the upstream side of the conveyance direction.

Each descender channel 132 is formed by through holes formed in the plates 122 to 125, overlapping in the vertical direction. One descender channel 132 is provided to each pressure chamber 130. Each descender channel 132 is connected to an end portion of the corresponding pressure chamber 130, on a downstream side of the conveyance direction and is extended downward from a connecting portion with the pressure chamber 130. Each return channel 133 is formed in the plate 125. One return channel 133 is provided to each descender channels 132. Each return channel 133 is connected to a lower end portion of the descender channel 132 and is extended from a connecting portion with the corresponding descender channel 132 toward the downstream side of the conveyance direction.

Each nozzle 135 is formed in the plate 126. One nozzle 135 is provided to each descender channel 132. Each nozzle 135 overlaps with the corresponding descender channel 132 in the vertical direction.

Moreover, in the channel unit 111, individual channels 128 are formed. Each individual channel 128 has one nozzle 135, one descender channel 132 which is connected to that nozzle 135, one pressure chamber 130 which is connected to that descender channel 132, and one throttle channel 131 which is connected to that pressure chamber 130. The individual channels 128 form an individual channel row 129 by being aligned in the paper-width direction. Moreover, four individual channel rows 129 are arranged in the conveyance direction in the channel plate 111. Furthermore, in the four individual channel rows 129, positions in the paper-width direction of the pressure chambers 130 forming the four individual channel rows 129 are misaligned.

The four supply manifolds 136 are formed by through holes formed in the plates 124 and 125, being overlapped in the vertical direction. Each supply manifold 136 is extended in the paper-width direction. The four supply manifolds 136 are arranged at an interval in the conveyance direction. Moreover, the fourth supply manifolds 136 correspond to the four individual channels rows 129 respectively. Each supply manifold 136 is connected to the throttle channels 131 included in the individual channels 128 forming the corresponding individual channel row 129. More specifically, each supply manifold 136 is connected to an end portion of each throttle channels 131, on a side opposite to the pressure chambers 130.

The four return manifolds are formed by through holes formed in the plates 124 and 125, being overlapped in the vertical direction. Each return manifold 137 is extended in the paper-width direction. The four return manifolds 137 correspond to the four supply manifolds 46 respectively. Each return manifold 137 is arranged at an upstream side of the conveyance direction of the corresponding supply manifold 46. Moreover, the four return manifolds 47 correspond to the four individual channel rows 129 respectively. Each return manifold 47 is connected to the return channels 133 included in the individual channels 128 forming the corresponding individual channel row 129. More specifically, each return manifold 137 is connected to an end portion of each return channel 133, on a side opposite to the descender channel 132.

Moreover, each supply manifold 136, at an end portion on a right side of the paper-width direction, is extended in the vertical direction through the plates 121 to 125, and an upper end portion thereof is provided with an inflow port 136*a*. Four inflow ports 136*a* of the four supply manifolds 136 communicate mutually and are connected to an ink tank 171 via a pump for circulation 172 (hereinafter, "circulation pump 171"). The ink tank 171 is connected to an ink cartridge which is not depicted in the diagram via a tube which is not depicted in the diagram and an ink supply thereto from the ink cartridge.

Moreover, each return manifold 137, at an end portion on a right side in the paper-width direction, is extended in the vertical direction through the plates 121 to 125, and an upper end portion thereof is provided with an outflow port 137*a*. Four outflow ports 137*a* of the four return manifolds 137 communicate mutually and are connected to the ink tank 171.

As the circulation pump 172 is driven, the ink inside the ink tank 171 flows into the supply manifold 136 through the inflow port 136*a*. Moreover, the ink flows into the individual channels 128 from the supply manifold 136, and the ink flows out from the individual channels 128 to the return manifold 137. Furthermore, the ink inside the return manifold 137 flows out through the outflow port 137*a* and flows toward the ink tank 171. Accordingly, the ink circulates between the ink-jet head 101 and the ink tank 171.

<Piezoelectric Actuator 112>

The piezoelectric actuator 112 includes two piezoelectric layers 141 and 142, a common electrode 143, and individual electrodes 144. The piezoelectric layers 141 and 142 are made of a piezoelectric material. The piezoelectric layer 141 is arranged on an upper surface of the channel unit 111, and the piezoelectric layer 142 is arranged on an upper surface of the piezoelectric layer 141.

The common electrode 143 is arranged between the piezoelectric layer 141 and the piezoelectric layer 142, and is extended continuously almost over the entire area of the piezoelectric layers 141 and 142. The individual electrodes 144 are provided to the pressure chambers 130. Each individual electrode 144 has a substantially rectangular flat shape with the conveyance direction let to be a longitudinal direction of the rectangular shape long in the conveyance direction, and is arranged to overlap in the vertical direction with a central portion of the corresponding pressure chamber 130.

Even in a printer equipped with the ink-jet head 101 having such arrangement, similarly as explained above, the unit circulation amount may be changed according to the standby time Tw, and the recovery operation may be carried out in accordance with the standby time Tw at a point of time of shifting from the standby state to the jetting operation. In this case, similarly as mentioned above, it is possible to suppress the electric power consumption to the minimum while shortening as much as possible the time after the print command is input till the jetting operation is started.

Moreover, although examples in which the present teaching was applied to a printer equipped with the so-called line head has been described above, the application of the present teaching is not restricted to such printer. The present teaching is also applicable to a printer equipped with a so-called serial head which is mounted on a carriage that moves in a scanning direction, and which jets an ink from nozzles while moving in the scanning direction along with the carriage.

Moreover, although examples in which the present teaching was applied to a printer which carries out recording on a recording paper by jetting an ink from the nozzles were described above, the application of the present teaching is not restricted to printers only. The present teaching is also applicable to a liquid jetting apparatus which jets liquid other than ink, such as a metal or a resin in the form of a liquid.

What is claimed is:

1. A liquid jetting apparatus comprising:

a liquid jetting head having individual channels, a first common channel connected to the individual channels, and a second common channel connected to the individual channels, the individual channels having nozzles respectively;

a pump configured to circulate liquid inside the liquid jetting head by generating a flow of the liquid from the first common channel toward the second common channel via the individual channels; and a controller, wherein the controller is configured to:

reduce a unit circulation amount of the liquid in stages as standby time becomes longer, the unit circulation amount being a circulation amount of the liquid per unit time by the pump, the standby time being a length of time during which a standby state is continued, the standby state being a state in which the liquid jetting head is ready without jetting the liquid from the nozzles; and in a case of shifting the liquid jetting head from the standby state to a jetting operation of jetting the liquid from the nozzles, determine a type of recovery operations for resolving thickening of the liquid inside the nozzles in accordance with the standby time at the time of shifting from the standby state to the jetting operation.

2. The liquid jetting apparatus according to claim 1, wherein in a case where the standby time is longer than a first time, the controller is configured to reduce the unit circulation amount to be smaller than a case where the standby time is shorter than or equal to the first time.

3. The liquid jetting apparatus according to claim 2, wherein in the case where the standby time is longer than the first time, the controller is configured to increase temporarily the reduced unit circulation amount every time a predetermined time is elapsed.

4. The liquid jetting apparatus according to claim 2, wherein in the case where the standby time is shorter than or equal to the first time, the unit circulation amount is equal to or larger than a reference circulation amount which prevents the liquid inside the nozzles from thickening, in the case where the standby time is longer the first time, the unit circulation amount is smaller than the reference circulation amount, in the case where the standby time is shorter than or equal to the first time and in the case of shifting the liquid jetting head from the standby state to the jetting operation, the controller is configured not to perform any type of the recovery operations, and in the case where the standby time is longer than the first time and in the case of shifting the liquid jetting head from the standby state to the jetting operation, the controller is configured to perform at least one type of the recovery operations.

5. The liquid jetting apparatus according to claim 2, wherein in the case where the standby time is longer than the first time and in the case of shifting the liquid jetting head from the standby state to the jetting operation, the controller is configured to temporarily increase the unit circulation amount as a type of the recovery operations.

6. The liquid jetting apparatus according to claim 2, wherein in a case where the standby time is longer than a second time, which is longer than the first time, and the liquid jetting head is shifted from the standby state to the jetting operation, time required for the recovery operations is longer than a case where the standby time is longer than the first time and shorter than or equal to the second time and the liquid jetting head is shifted from the standby state to the jetting operation.

7. The liquid jetting apparatus according to claim 6, wherein in the case where the standby time is longer than the second time and the liquid jetting head is shifted from the standby state to the jetting operation, the controller is configured to perform an operation in which the unit circulation amount is temporarily increased and a flushing operation in which the liquid jetting head is caused to discharge the liquid from the nozzles, as the recovery operations.

8. The liquid jetting apparatus according to claim 7, further comprising:

a liquid receiver configured to receive the liquid discharged from the nozzles by the flushing operation; and a first relative movement mechanism configured to move the liquid jetting head and the liquid receiver relatively to switch between a facing state and a non-facing state, the facing state being a state in which the liquid jetting head and the liquid receiver face each other, the non-facing state being a state in which the liquid jetting head and the liquid tray do not face, wherein the controller is configured to control the first relative movement mechanism to make the liquid jetting head and the liquid receiver in the facing state before the standby time becomes longer than the second time.

9. The liquid jetting apparatus according to claim 7, wherein in a case where the standby time is shorter than or equal to a third time which is longer than the second time, the controller is configured to control the pump to circulate the liquid inside the liquid jetting head, and at a timing at which the standby time becomes longer than the third time, the controller is configured to control the pump to stop circulating the liquid inside the liquid jetting head.

10. The liquid jetting apparatus according to claim 9, further comprising:

a cap configured to cover the nozzles; and a second relative movement mechanism configured to move the liquid jetting head and the cap relatively to switch between a capping state and an uncapping state, the capping state being a state in which the nozzles are covered by the cap, the uncapping state being a state in which the cap is separated from the liquid jetting head, wherein in the case where the standby time is shorter than or equal to the third time, the controller is configured to control the second relative movement mechanism to make the liquid jetting head and the cap in the uncapping state, and at the timing at which the standby time becomes longer than the third time, the controller is configured to control the second relative movement mechanism to switch from the uncapping state to the capping state.

11. The liquid jetting apparatus according to claim 10, wherein at the timing at which the standby time becomes longer than the third time, the controller is configured to perform the flushing operation by controlling the liquid jetting head and then control the second relative movement mechanism to switch from the uncapping state to the capping state.

12. The liquid jetting apparatus according to claim 9, wherein at the timing at which the standby time becomes longer than the third time, the controller is configured to control the pump to temporarily increase the unit circulation amount and then control the pump to stop circulating the liquid inside the liquid jetting head.

13. The liquid jetting head according to claim 9, wherein in a case where the standby time is longer than the third time and the liquid jetting head is shifted from the standby state to the jetting operation, time required for the recovery operations is longer than a case where the standby time is longer than the second time and shorter than or equal to the third time and the liquid jetting head is shifted from the standby state to the jetting operation.

14. The liquid jetting apparatus according to claim 13, further comprising:

a cap configured to cover the nozzles; and a purge mechanism configured to perform a purge operation in which the liquid inside the liquid jetting head is forcibly discharged to the cap, wherein in the case where the standby time is longer than the third time and the liquid jetting head is shifted from the standby state to the jetting operation, the controller is configured to control the purge mechanism to perform the purge operation as a type of the recovery operations.

15. The liquid jetting apparatus according to claim 9, wherein at the timing at which the standby time becomes longer than the third time, the controller is configured to put an electric power supply OFF.

16. The liquid jetting apparatus according to claim 9, wherein the first time is shorter than both of a difference between the first time and the second time and a difference between the second time and the third time.

* * * * *